US008419163B2

(12) United States Patent
Takafuji

(10) Patent No.: US 8,419,163 B2
(45) Date of Patent: Apr. 16, 2013

(54) INKJET DRAWING APPARATUS

(75) Inventor: Yoshifumi Takafuji, Kodaira (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 13/139,834

(22) PCT Filed: Dec. 7, 2009

(86) PCT No.: PCT/JP2009/070461
§ 371 (c)(1),
(2), (4) Date: Jun. 15, 2011

(87) PCT Pub. No.: WO2010/071041
PCT Pub. Date: Jun. 24, 2010

(65) Prior Publication Data

US 2011/0249059 A1 Oct. 13, 2011

(30) Foreign Application Priority Data

Dec. 18, 2008 (JP) ..... 2008-322445

(51) Int. Cl.
*B41J 2/165* (2006.01)

(52) U.S. Cl.
USPC ..... 347/32

(58) Field of Classification Search ..... None
See application file for complete search history.

(56) References Cited

U.S. PATENT DOCUMENTS

2008/0024532 A1* 1/2008 Kim ..... 347/9

FOREIGN PATENT DOCUMENTS

JP 2005-254800 A 9/2005
JP 2005-313412 A 11/2005
JP 2008-155113 A 7/2008

OTHER PUBLICATIONS

International Search Report dated Mar. 9, 2011 issued in International Appln. No. PCT/JP2009/070461.

* cited by examiner

*Primary Examiner* — Matthew Luu
*Assistant Examiner* — Alejandro Valencia
(74) *Attorney, Agent, or Firm* — Holtz, Holtz, Goodman & Chick, P.C.

(57) ABSTRACT

An inkjet drawing apparatus includes a head module which holds a droplet jetting head provided with a nozzle for ejecting droplets, and which is unmovable in a horizontal direction, and a drawing table which supports a recording member on an upper surface, and which is movable in the horizontal direction. The inkjet drawing apparatus executes a prescribed drawing by ejecting the droplets onto the recording member from the droplet jetting head. A maintenance unit transfer mechanism is movable within a prescribed region including a position under the head module, and transfers a maintenance unit for conducting a maintenance of the droplet jetting head toward the position under the head module, and executes positioning of the maintenance unit with respect to the droplet jetting head. A maintenance unit selecting/arranging mechanism selects one of a plurality of kinds of maintenance units, and places the selected maintenance unit on the maintenance unit transfer mechanism.

8 Claims, 19 Drawing Sheets

INKJET DRAWING APPARATUS

This application is a U.S. National Phase Application under 35 USC 371 of International Application PCT/J2009/070461 filed Dec. 7, 2009.

TECHNICAL FIELD

The present invention relates to an inkjet drawing apparatus, and specifically relates to an inkjet drawing apparatus that enables highly accurate maintenance without requiring increase of the length and dimensions of a stage on the apparatus base table.

BACKGROUND TECHNOLOGY

In recent years fine processing technologies utilizing inkjet technologies have attracted rising attention. For example, in the manufacturing field of a color filter to be used for a liquid crystal display panel, a wiring pattern of semiconductor and the like, requirements are increasing to land the various types of liquid droplets ejected from a droplet jetting head (hereinafter referred as a head) at a fine target on a work (recorded member) with errors of approximately 1 μm.

In order to control the landing position with a high degree of accuracy, the head position is preferably arranged at a equally high accurate position. Further, maintenance work to ensure the appropriate landing position of the liquid droplet is necessary.

Conventionally, to conduct maintenance, Patent Document 1 discloses an apparatus where a maintenance area is provided in the apparatus main body adjacent to a drawing area, and at the time of maintenance, a carriage holding a head is moved to the maintenance area.

Further, Patent Document 2 discloses to make the head unmovable on the apparatus base table, and provide a plurality of types of maintenance units on the same apparatus base table to be horizontally movable within a prescribed region including a portion just under the head, and at the time of maintenance to move a required maintenance unit to a position just under the head.

PRIOR ART DOCUMENT

Patent Document

Patent Document 1: Unexamined Japanese Patent Application Publication No. 2005-254,800

Patent Document 2: Unexamined Japanese Patent Application Publication No. 2008-155,113

SUMMARY OF THE INVENTION

Problems to be Solved by the Invention

According to the technology disclosed in Patent Document 1, since it is necessary to move a carriage holding the head to the maintenance area at the time of maintenance, backlash is caused by the movement of the carriage to generate fine misalignments at the position of head arrangement, which may cause a shift of droplet landing position. Since inkjet drawing apparatuses require extremely high landing position accuracy in μm order, quite a small head positional shift may become very critical.

For this reason, the configuration as described in Patent Document 2 is preferable, where the head is arranged to be unmovable and the maintenance units are moved to the position just under the head.

However in the case of arranging the head to be unmovable, in addition to the installation area and moving area of the drawing table to hold the work, namely the object being drawn, areas for installation and movement of the maintenance units are required. The maintenance units generally include a capping unit to prevent the nozzle surface of head from drying, a sucking unit to forcibly suck the ink from the nozzle, a flushing tray to pick up the forcibly ejected ink from the nozzle, a wiping unit to wipe the blots such as the residual ink attached on the nozzle surface, and the likes. These plural kinds of maintenance units are required to be installed on a stage to be usable. Therefore, these installation areas are necessary to be secured on the stage, which causes the problem of increasing the length and the dimensions of the stage.

Further, since both the drawing table and the maintenance units need to be positioned in high accuracy with respect to the head, the movement of these units also needs to be conducted with high accuracy. Since the movement of these units are required of high accuracy, in addition to the problem of extremely high cost of the stage for executing such high accuracy movement, a problem of generating small positional shifts of the head may be caused, since the stage is required to move a relatively long distance for using the prescribed maintenance unit and vibration accompanied by the movement transfers from the apparatus base table to the head.

Therefore, an object of the present invention is to provide an inkjet drawing apparatus that enables to execute highly accurate maintenance by positioning the maintenance units at the head, and suppress the generation of head position shift due to vibration, without requiring an increase of the length and the dimensions of the stage.

Other objects of the present invention will be disclosed in the description below.

Means for Solving the Problem

The above object will be solved by each invention described below.

According to an aspect of the present invention, an inkjet drawing apparatus includes a head module which holds a droplet jetting head provided with a nozzle for ejecting droplets, and is configured to be unmovable in a horizontal direction; and a drawing table which supports a recording member on whose upper surface, and is configured to be movable in the horizontal direction; where the inkjet drawing apparatus executes a prescribed drawing by ejecting the droplets onto the recording member from the droplet jetting head, and further comprising a maintenance unit transfer means which is configured to be movable within a prescribed region including a position just under the head module, and which transfers a maintenance unit for conducting a maintenance of the droplet jetting head toward the position just under the head module, and executes positioning of the maintenance unit with respect to the droplet jetting head; and a maintenance unit selecting/arranging means which selects any one of a plurality of kinds of maintenance units for conducting the maintenance of the droplet jetting head, and places the selected maintenance unit on the maintenance unit transfer means.

According to another aspect of the present invention, the inkjet drawing apparatus further includes a relative position measuring means which measures a relative position between the head module and the maintenance unit being transferred by the maintenance unit transfer means, wherein the maintenance unit transfer means executes a fine adjustment of a position of the maintenance unit based on a value measured by the relative position measuring means.

According to another aspect of the present invention, the maintenance unit selecting/arranging means is configured with a robot arm capable of holding one maintenance unit at an end of the robot arm.

According to another aspect of the present invention, the maintenance unit selecting/arranging means is configured to be capable of slide movement along a gantry which is provided to step over the maintenance unit transfer means, and also capable of up-and-down movement, and wherein the maintenance unit selecting/arranging means comprises a hand unit which can hold one maintenance unit at a lower end of the hand unit.

According to another aspect of the present invention, the inkjet drawing apparatus further includes a maintenance unit arranging table, on whose upper surface the plurality of kinds of maintenance units are arranged.

According to another aspect of the present invention, the head module and the drawing table are arranged on a common fixed platen, and the maintenance unit selecting/arranging means is not arranged on the common fixed platen.

According to another aspect of the present invention, the drawing table and the maintenance unit transfer means are provided on a common stage which is movable in the horizontal direction within the prescribed region including the position just under the head module, and rotatable about an axis perpendicular to the upper surface of the drawing table.

According to another aspect of the present invention, the drawing table is configured to move to a position where the drawing table does not interfere with the maintenance unit at the time of maintenance by the maintenance unit, and ensures a space to insert the maintenance unit under the head module.

According to another aspect of the present invention, an inkjet drawing apparatus includes a head module which holds a droplet jetting head provided with a nozzle for ejecting droplets, and is configured to be unmovable in a horizontal direction; and a drawing table which supports a recording member on an upper surface, and is configured to be movable in the horizontal direction, wherein the inkjet drawing apparatus executes a prescribed drawing by ejecting the droplets onto the recording member from the droplet jetting head, and further comprising: a maintenance unit transfer means which is configured to be movable within a prescribed region including a position just under the head module, transfers a maintenance unit for conducting a maintenance of the droplet jetting head toward the position just under the head module, and executes positioning of the maintenance unit with respect to the droplet jetting head, wherein the maintenance unit is provided at an end of the maintenance unit transfer means configured with a robot aim which is movable in horizontal and vertical directions within the prescribed region including the position just under the head module.

According to another aspect of the present invention, the maintenance unit transfer means has, on its end, a rotary table on which a plurality of kinds of maintenance units are arranged.

According to another aspect of the present invention, the head module and the drawing table are arranged on a common fixed platen, and the maintenance unit transfer means is not arranged on the common fixed platen.

Effect of the Invention

According to the present invention, an inkjet drawing apparatus can be provided which can suppress positional shifts of a head due to vibration without requiring an increase of length and dimensions of a stage, and highly accurate maintenance is made possible by positioning a maintenance unit to the head.

DETAILED DESCRIPTION OF THE PREFERRED EMBODIMENTS

Figure 1:
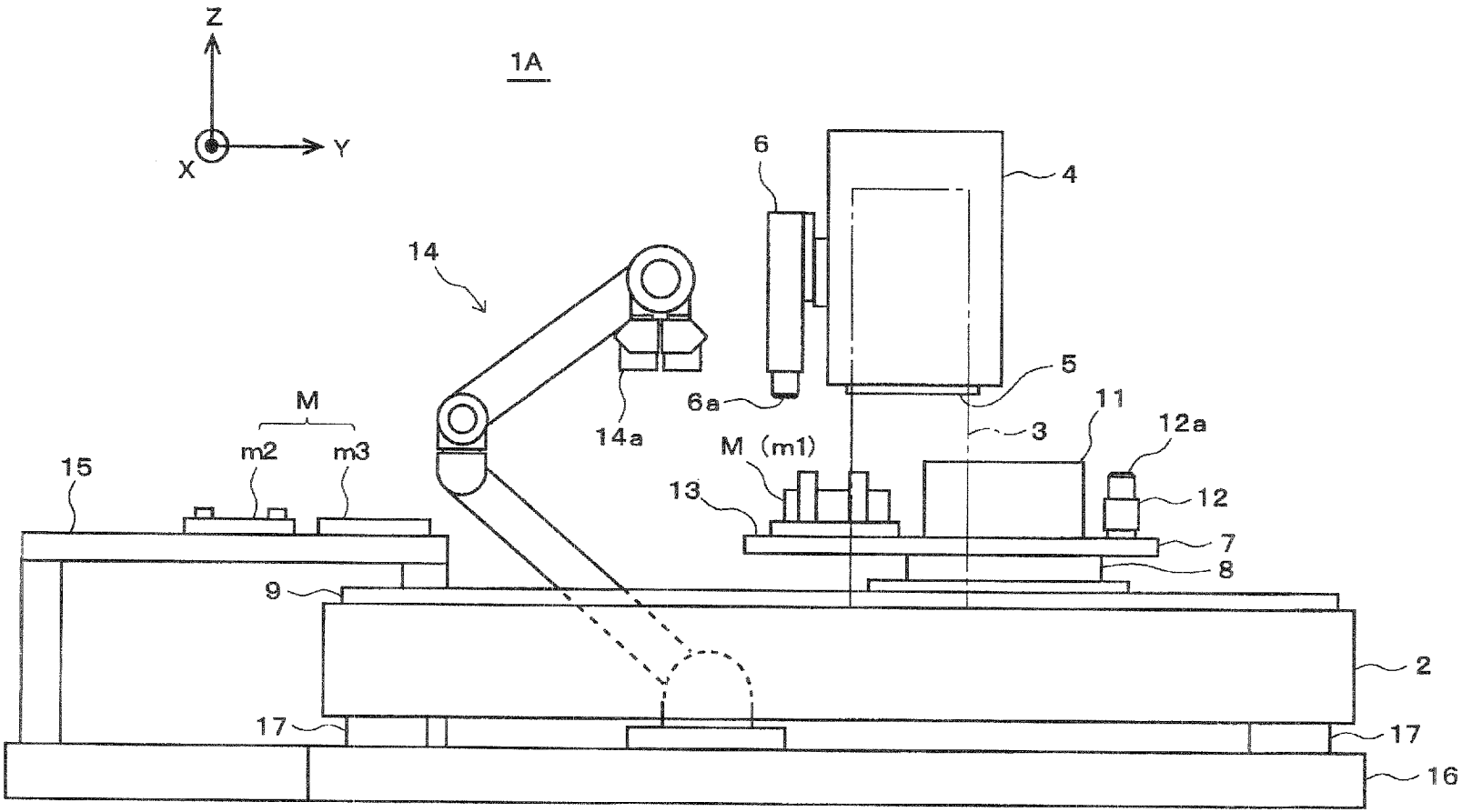
FIG. 1 is a side elevation view of an inkjet drawing apparatus relating to the first embodiment.

Hereinafter, embodiments of the present invention will be described in detail referring to the drawings.

First Embodiment

Figure 2:
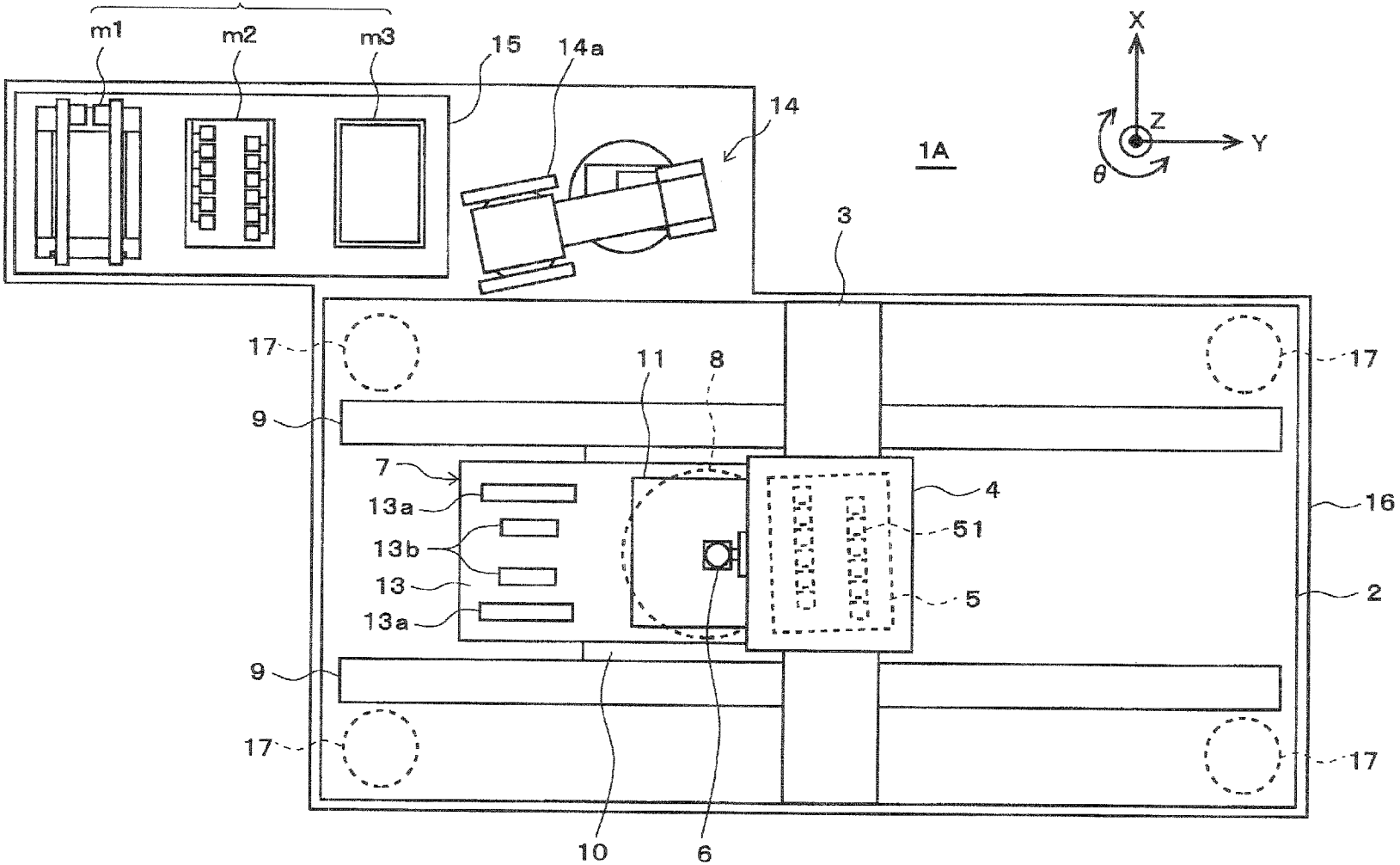
FIG. 2 is a plan view of an inkjet drawing apparatus relating to the first embodiment.

FIG. 1 is a side elevation view of an inkjet drawing apparatus relating to the first embodiment of the present invention, and FIG. 2 is its plan view.

In inkjet drawing apparatus 1A, gantry 3 made of stone is provided along X-direction in the drawing on fixed platen 2, being rectangular planer view, made of stone. Said gantry 3 is shown by dashed lines in FIG. 1. On gantry 3, Z-stage 4 is provided which is vertically movable along the Z-direction in the drawing. Z-stage 4 is structured to be movable only vertically and unmovable in horizontal direction, and at the bottom end of Z-stage, head module 5 is provided.

Figure 3:
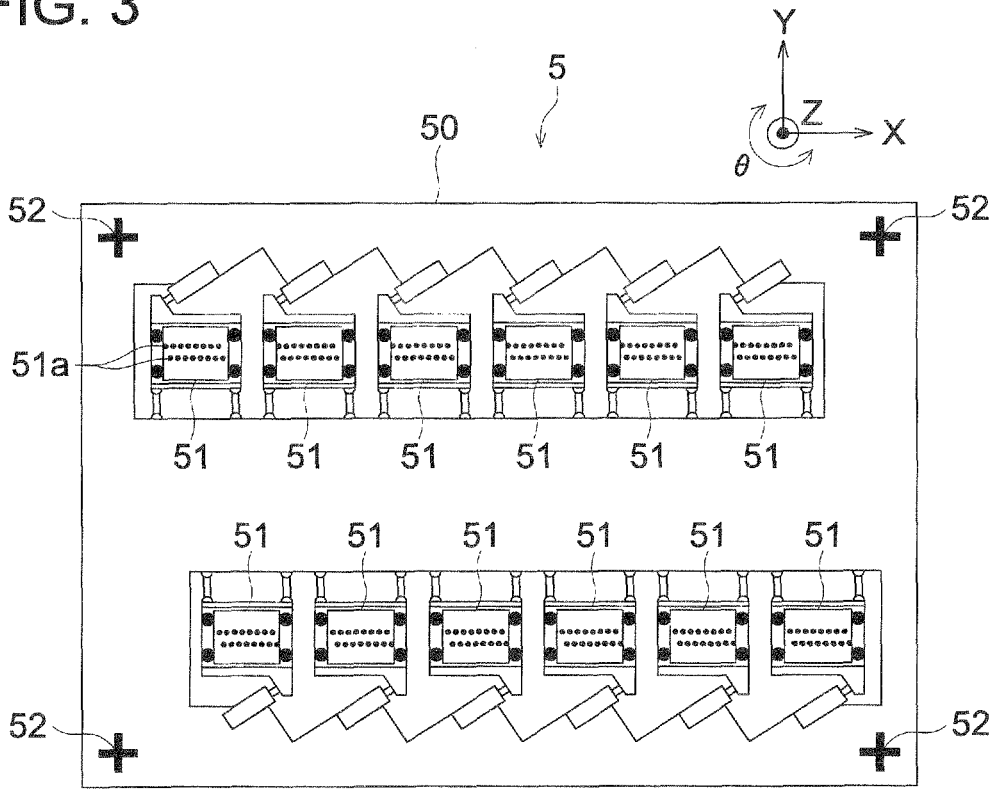
FIG. 3 is a bottom view of a head module.

FIG. 3 is a bottom view of head module 5 in which, a plurality of droplet jetting heads (hereinafter referred as "head") 51, each of which is arranged with a plurality of nozzles 51*a*, are arranged and held in zigzag arrangement along the array direction of nozzles 51*a* on base plate 50, thus structuring a line head having long length in X-direction in the drawing. On the bottom surface of base plate 50, cross-shaped position confirming markers 52 are formed at four appropriate corner positions. Wherein, markers 52 are arranged such that a line connecting two markers 52 separately formed along the X-direction is parallel to the nozzle row direction of each head 51. Head module 5 is arranged such that the nozzle surface of each head 51 faces downward, and can be place to be parallel to the surface of a recording member (not illustrated) arranged under each head 51. Head module 5 is installed at the bottom end of Z-stage 4 via a θ rotation mechanism (not illustrated) for rotating head module 5 in θ direction about an axis along the Z-direction.

Further, on the side surface of Z-stage 4, first camera 6 is provided as one body for visually confirming downward positions from the Z-stage. First camera 6 is a maintenance unit conforming camera configured with CCD and the like for confirming the position and posture of maintenance unit M (to be described later) being arranged downward, in the present embodiment. First camera 6 is installed as vertically movable independently with respect to Z-stage 4 by facing lens surface 6*a* downward. This vertical movement of first camera 6 is conducted to confirm the markers formed at the prescribed positions in cases of image confirmation of the position of maintenance unit M.

On fixed platen 2, provided are: transfer stage 7 for transporting the recording material; θ rotation mechanism 8 for rotating the transfer stage 7 in θ direction about an axis along the Z-direction; Y-movement mechanism 9 for linearly moving both transfer stage 7 and θ rotation mechanism 8 along the Y-direction in the drawing; and X-movement mechanism 10 for linearly moving both transfer stage 7 and θ rotation mechanism 8 along the X-direction in the drawing.

Wherein, X-direction and Y-direction are mutually perpendicular in the horizontal plane parallel to the upper surface of fixed platen 2, when the X direction indicates a sub-scanning direction and Y-direction indicates a main-scanning direction. Z-direction is perpendicular to the upper surface of fixed platen 2, and orthogonal to both the X-direction and Y-direction.

Transfer stage 7 is a rectangular flat plate in the planer view, and on the upper surface of transfer stage 7, provided in one body are drawing table 11, and second camera 12 in the vicinity of the drawing table 11, for visually observing upward.

The upper surface of drawing table 11 is made parallel to the upper surface of fixed platen 2, and a recording material (not illustrated), which is an object to execute a prescribed drawing by receiving the droplets ejected from head module 5, is placed and held on the upper surface. This drawing table 11 is formed to protrude upward from the surface of transfer stage 7. Rotation center of θ rotation mechanism 8 is set at the central position of drawing table 11.

Second camera 12 is a head position confirming camera configured with CCD and the like for confirming the position and posture of head module 5 arranged upside, in the present embodiment. Second camera 12 is installed by being laid at a prescribed position on the upper surface of transfer stage 7, in an unmovable position with respect to transfer stage 7.

Further, upper surface of transfer stage 7 protrudes laterally along the Y-direction in the drawing than the installation space of drawing table 11 and second camera 12. Maintenance unit installation section 13 for installing a maintenance unit (to be described later) is formed on the upper surface space of the protruded portion. Maintenance unit installation section has minimal sufficient space for installing any of one of the plurality of kinds of maintenance units M. Due to this, although enabling the maintenance by the plural kinds of maintenance unit M, transfer stage 7 remains from being unnecessary enlarged size, and further, the moving distance for moving the maintenance unit M to be installed on this section to just under the head module 5 can be kept in minimum.

Since drawing table 11 is formed to be higher than the surface of transfer stage 7, a large height difference is generated between drawing table 11 and the upper surface of the maintenance unit installation section 13. By making this height difference approximately the same as the maximum height of maintenance unit M to be installed on maintenance unit installation section 13, a space capable of inserting maintenance unit M can be ensured between head module 5 and maintenance unit installation section 13 at the time of maintenance operation, and the vertical moving distance for movement of head module 5 can remain short.

On maintenance unit installation section 13, holding mechanism 13*a* is provided for holding the installed maintenance unit M to be unmovable during maintenance. Specifically structured holding mechanism 13*a* is not required, but a lock mechanism to mechanically hold maintenance unit M to be unmovable, a suction mechanism to suck the maintenance unit M to be unmovable by air suction or magnetic force, and the like can be applied.

Transfer stage 7 is configured to be movable in a prescribed region including just under the portion of head module 5 installed on Z-stage 4 in horizontal directions (X, Y, and θ directions), by rotation movement in θ direction by θ rotation mechanism 8, and by movement along X-movement mechanism 10 and Y-movement mechanism 9. Therefore, maintenance unit M installed at maintenance unit installation section 13 on this transfer stage 7 can be transported to be just under head module 5 by the horizontal movement of transfer stage 7. The maintenance unit transfer means of the present invention is configured of this transfer stage 7.

Each position of transfer stage 7 in X-direction, Y-direction and θ-direction is configured to be detected with high accuracy by unillustrated encoders.

At the side of fixed platen 2 is provided a maintenance unit installation mechanism 14 for installing maintenance unit M at maintenance unit installation section on transfer stage. In this case, maintenance unit installation mechanism 14 is configured of a multiple-jointed robot arm, which is separately structured from fixed platen 2 without being installed on fixed platen 2, and is installed on maintenance unit arrangement table 15 provided at the side of fixed platen. On maintenance unit arrangement table 15, plural kinds of maintenance unit units M (m1, m2, m3) are arranged to be capable of selective usage.

Maintenance unit installation mechanism 14 has hand unit 14*a* at its front end, and is configured to select and hold any one of maintenance unit M (m1, m2, or m3) from plural kinds of maintenance unit M (m1, m2, and m3), to transport to the proper position of maintenance unit installation section 13 on transfer stage 7 by driving of each joint, and to install on said maintenance unit installation section 13. Therefore, the maintenance unit selection arranging means of the present invention is configured of this maintenance unit installation mechanism.

As shown in FIG. 1, fixed platen 2 is mounted via vibration-free mechanism 17 such as an air suspension system on apparatus base table 16. Although, maintenance unit installation mechanism 14 and maintenance unit arrangement table 15 may be provided on apparatus base table 16, as shown in the figure, they may be provided on a separate body, such as on the floor. According to the present embodiment, since maintenance unit installation mechanism 14 is not installed on fixed platen 2, vibration generated in accordance with its drive can be prevented from directly being transferred to fixed platen 2. Therefore, even if maintenance unit installation mechanism 14 is provided on apparatus base table 16, any vibration generated in accordance with its drive is suppressed to be directly transferred to fixed platen 2, and is sufficiently reduced by vibration-free mechanism 17, which can reduce the influence on installation condition of each head 51 of head module 5. Further, since fixed platen 2 does not require the installation space of maintenance unit installation mechanism 14, expensive fixed platen 2 can be downsized to requisite minimum, which enables to reduce costs.

Figure 4:
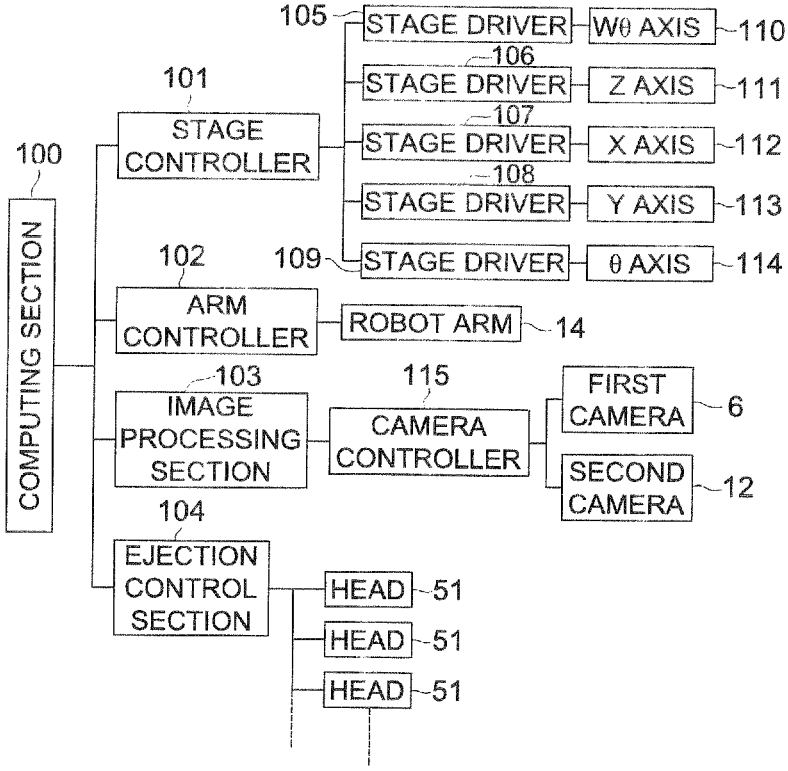
FIG. 4 is a block diagram showing schematically the internal configuration of the inkjet drawing apparatus.

FIG. 4 is a block diagram showing schematically the internal configurations of inkjet drawing apparatus 1A.

Designation 100 shows a computing section (CPU) to control the total system, and controls each of stage controller 101, arm controller 102, image processing section 103, and ejection control section 104.

Stage controller 101 controls the drive of stage driver 105 and 106 based on control signals from computing section 100, and respectively drives θ axis motor 110 for rotating head module 5 installed on Z-stage 4 in the θ direction, and Z axis motor 111 for vertical movement of Z-stage 4 in the Z-direction.

Based on control signals from computing section 100, stage controller 101 controls the drive of stage drivers 107-109 to respectively drive X-axis motor 112 to move transfer stage 7 in the X-direction, Y-axis motor 113 to move in Y-direction, and θ-axis motor 114 to rotate in the θ-direction.

Based on control signals from computing section 100, arm controller 102 drives the robot arm as maintenance unit installation mechanism 14 to control various movements.

Based on control signals from computing section 100, image processing section 103 controls the drive of camera controller 115 to execute image capturing operations of the first camera installed on Z-stage 4, and the second camera installed on transfer stage 7, and to execute processing of captured image.

Based on control signals from computing section 100, ejection control section 104 controls the drive of each head 51 in head module 5 to execute ink jetting process based on prescribed drawing data.

Here, various kinds of maintenance unit M will be described.

Figure 5:
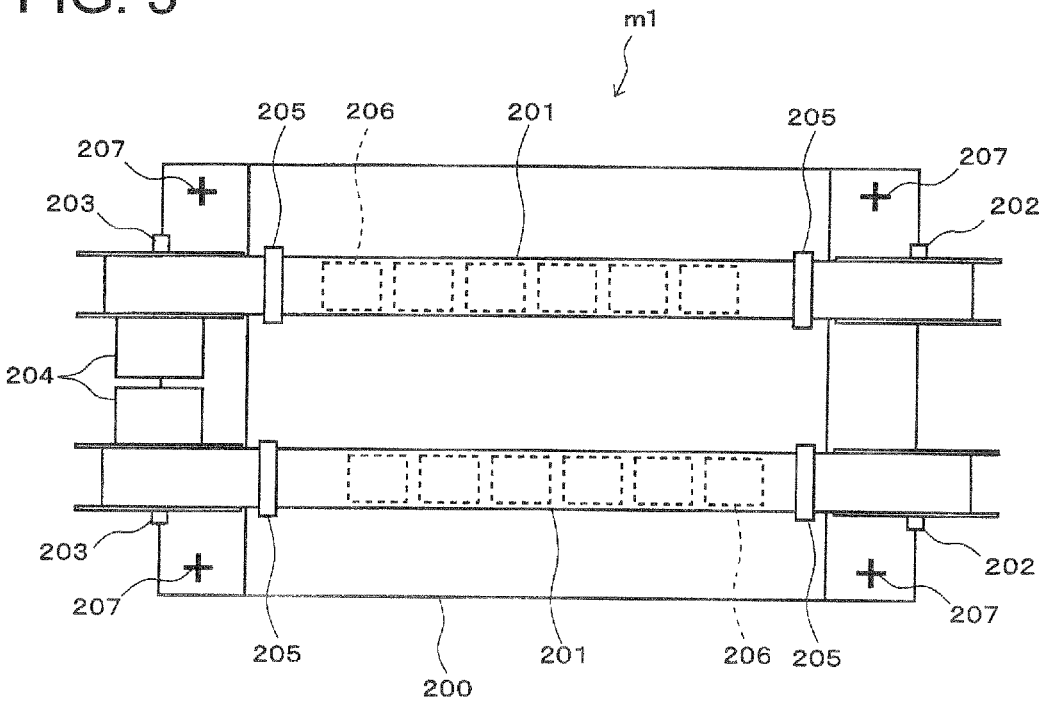
FIG. 5 is a plan view of a wiping unit.

FIG. 5 shows the plan view of wiping unit m1, which is provided with wiping member 201 arranged on planar view rectangle base plate 200 in two rows corresponding to two rows of heads arranged on head module 5.

Each wiping member 201 is formed to be a shape of long length tape having a width approximately the same as that of the nozzle surface of head 51, is rolled around roller 202, and is arranged in parallel at an edge portion on base plate 200, with the interval same as the row interval of head 51. Leading edge of wiping member 201 is capable of being taken up by take-up roller 203 arranged at the other end of base plate 200. Designation 203 is a motor to rotate take-up roller 203.

Between roller 202 and take-up roller 203, two pairs of holding rollers 205 are respectively provided to cause a prescribed tensile force on wiping member 201 between them. The interval distance between the two pairs of holding rollers 205 is made a little greater than the width in sub-scanning direction of all heads 51 arranged on head module 5. The surface of wiping member 201 nipped by the two pairs of holding rollers 205 configures a wiping surface for wiping the nozzle surface of each head 51 on head module 5. At the back side of the wiping surface, wiper head 206 corresponding to each head is provided, to support the back surface of wiping member 201 to enhance the wiping effect by contacting the wiping surface to the nozzle surface of each head 51.

At proper positions in the four corners on upper surface of base plate 200, cross-shaped positioning markers 207 are formed.

Wiping unit m1 is placed and positioned at maintenance unit installation section 13 on transfer stage 7, and each wiping member 201 and head 51 are brought into contact, after that, by driving motor 204 to take up the wiping member 201 around take-up roller axis 203, the wiping surface wipes each nozzle 51 for cleaning the nozzle surface.

Power source to drive each motor 204 may be supplied from a power cord connected to a power connector (not illustrated), or may be supplied by providing electrode 13*b* for power supply on maintenance unit installation section 13 as shown in FIG. 2, and in cases where wiping unit m1 is installed, connecting the electrode 13*b* to an electrode (not illustrated) provided on the wiping unit m1.

Figure 6:
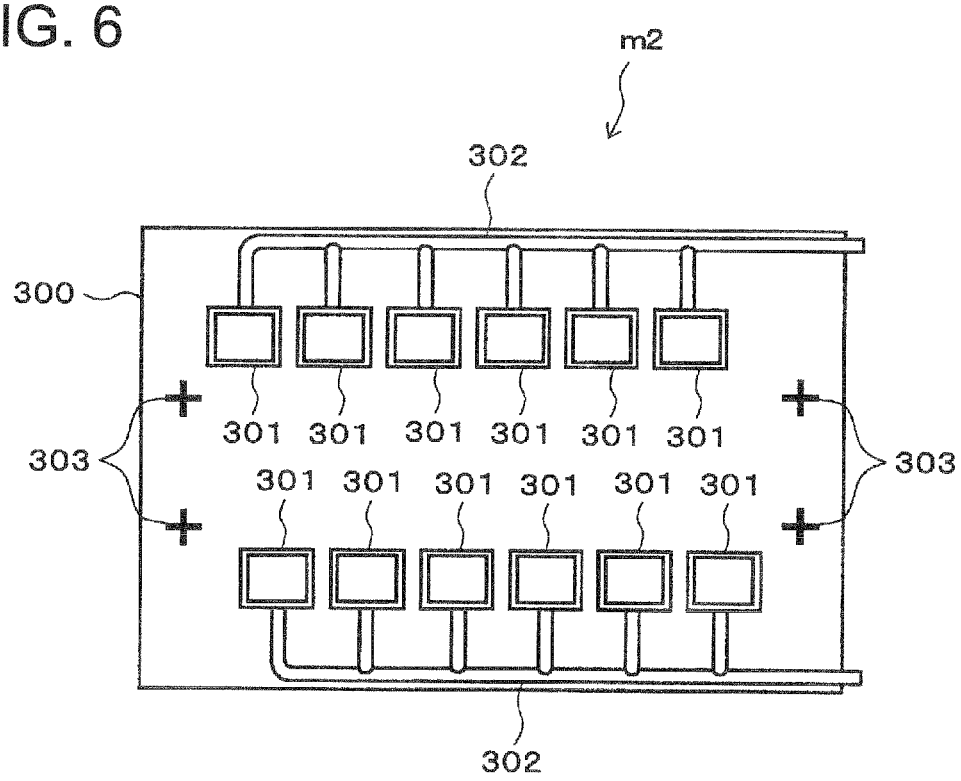
FIG. 6 is a plan view of a sucking unit.

FIG. 6 shows the plan view of sucking unit m2, which is provided with sucking cap 301 arranged on planar view rectangle base plate 300 corresponding to the number and arrangement of each head 51 on head module 5. To each sucking cap 301, one end of sucking pipe 302 is connected. The other end of sucking pipe 302 is connected to a suction pump (not illustrated), and air in each sucking cap 301 is sucked by the drive of suction pump.

At the proper positions in four corners on upper surface of base plate 300, cross-shaped positioning markers 303 are formed.

Sucking unit m2 is placed and positioned at maintenance unit installation section 13 on transfer stage 7, and each sucking cap 301 and each head 51 are made to be in close contact, after that, by driving the suction pump to make a negative pressure state in each sucking cap 301, and forcibly sucking ink from nozzle 51*a* of each head 51, clearance of ink clogging and ejection of air bubble are performed. Further, after making the close contact of each sucking cap 301 and each head 51, by keeping not to drive the suction pump, it may function to prevent the drying up in nozzle 51*a*.

Figure 7:
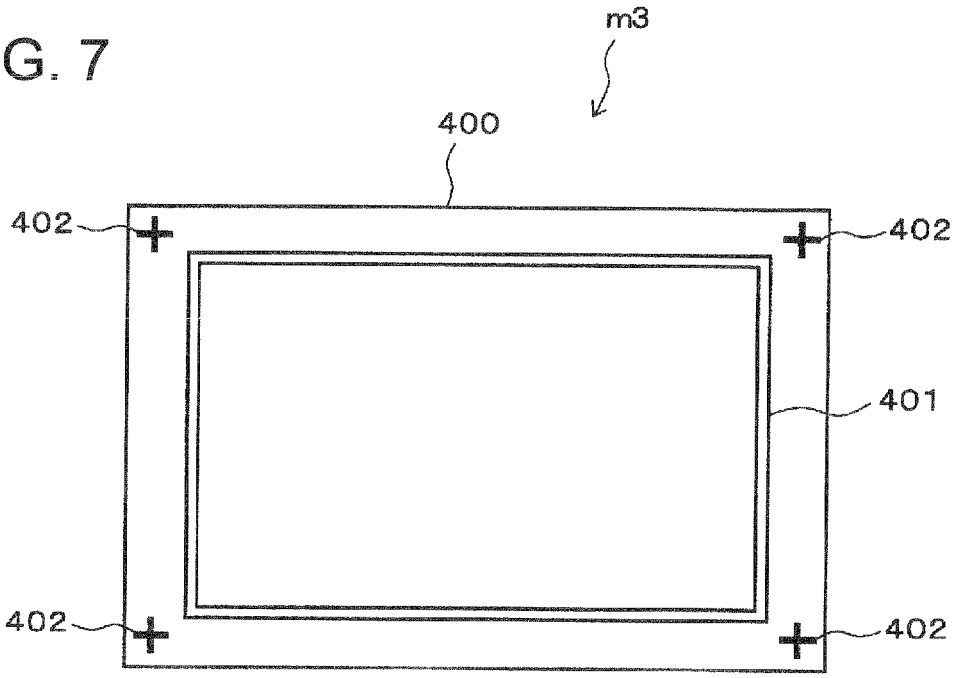
FIG. 7 is a plan view of a flushing tray.

FIG. 7 shows the plan view of flushing tray m3, which is provided with tray 401 with the size capable of enclosing all heads 51 of head module 5, on planar view rectangle base plate 400.

At proper positions in the four corners on the upper surface of base plate 400, cross-shaped positioning markers 402 are formed.

Hushing tray m3 is placed and positioned on maintenance unit installation section 13 on transfer stage 7, and after being arranged under head module 5 receives droplets forcibly ejected from each nozzle 51*a* into tray 401, for clearance of nozzle clogging and for homogenization of each nozzle 51*a*.

These various kinds of maintenance unit M (m1, m2, and m3) are arranged on maintenance unit arrangement table 15. Since positions for those units are not strictly specified, after grabbing a desired maintenance unit M (mi, m2, or m3) by driving the arm, maintenance unit installation mechanism 14 needs to precisely position it toward each head 51 of head module 5.

Next, maintenance operations of the inkjet drawing apparatus 1A will be described by use of flow charts shown in FIGS. 8-10, and plan views of FIGS. 11-15 illustrating the operations of inkjet drawing apparatus 1A. The maintenance operation described below is executed by the control of computing section 100 based on a prescribed program previously stored in a prescribed area in computing section 100 or in an unillustrated storage device.

When a predetermined maintenance time comes, maintenance content, predetermined or determined by an operator, is selected (S1). Here, among a plurality of kinds of maintenance operations, the wiping operation is assumed to be executed by use of wiping unit m1.

In a case when wiping is selected in maintenance content selection, the maintenance operation reads out maintenance device basic data regarding wiping unit m1 for executing the wiping (S2), drives maintenance unit installation mechanism 14 based on position data in the maintenance device basic data, grabs and holds wiping unit m1 out of the plurality of kinds of maintenance unit M (m1, m2, m3) with fore hand unit 14*a*, conveys it onto transfer stage 7, and installs it on maintenance unit installation section 13. At this time, maintenance unit M is installed in a state of having been fixed in position to a certain extent with respect to head module 5 (S3, FIG. 11). After said installation, wiping unit m1 is held securely on maintenance unit installation section 13 by holding mechanism 13*a*.

At this time, transfer stage 7 has moved to and stopped at a prescribed position (installation waiting position) such that maintenance unit installation section 13 evacuates sufficiently from the position under Z-stage 4. The installation waiting position is previously determined and its positional coordinates are included in the maintenance device basic data read out in the step S2.

Figure 12:
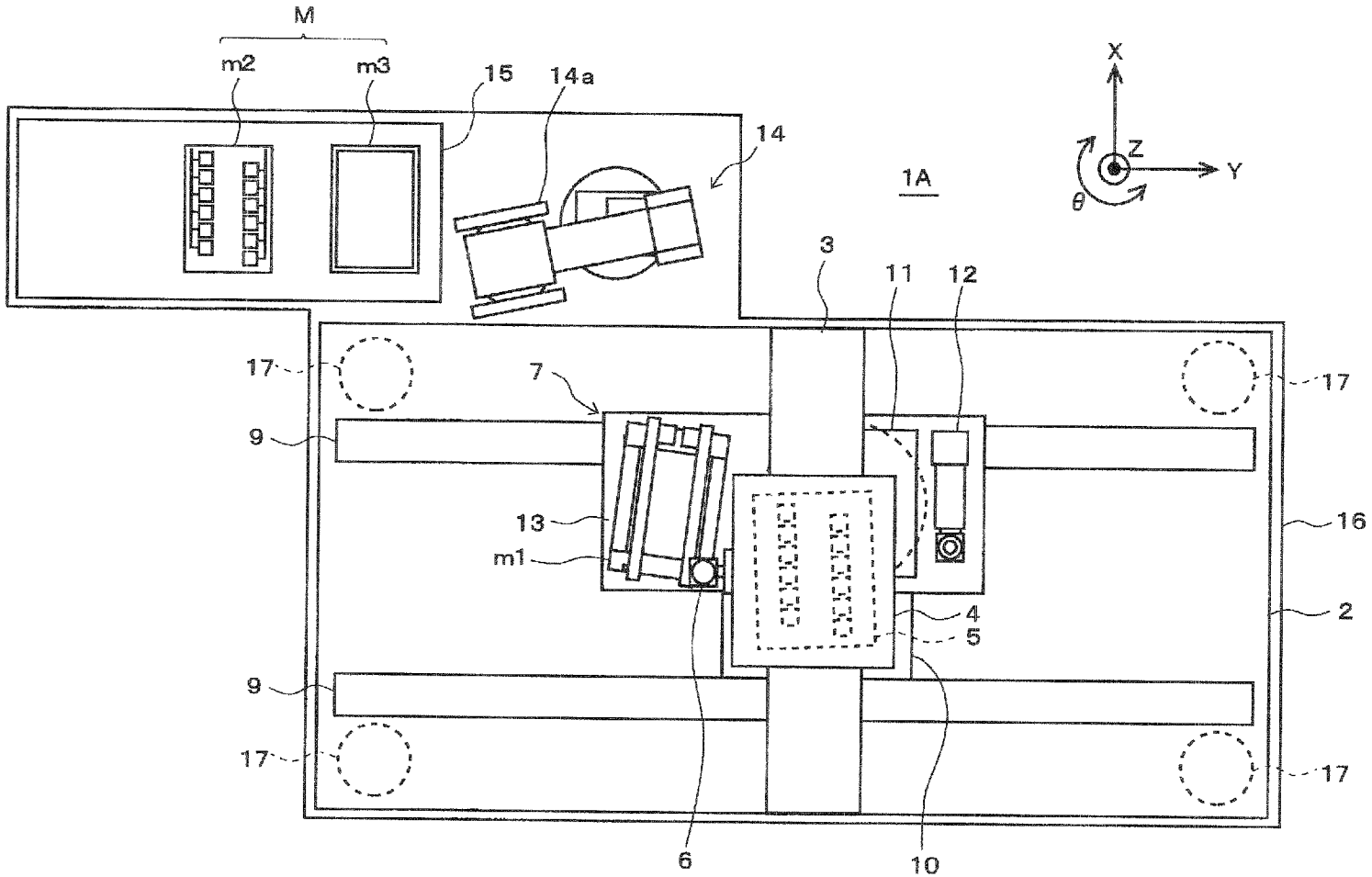
FIG. 12 is a plan view showing maintenance operations in the inkjet drawing apparatus relating the first embodiment.

After wiping unit m1 has been installed and secured to maintenance unit installation section 13, by moving transfer stage 7 in the X, and Y directions, the first camera 6 attached to Z-stage 4 confirms of any positioning marker 207 on wiping unit m1 through image confirmation (S4, FIG. 12). This confirmation operation is repeated for times of the number of positioning marker 207, to obtain positional coordinate of each marker. After obtaining the positional coordinates of each positioning marker 207, the posture of wiping unit m1 is calculated from each positional coordinate.

Figure 9:
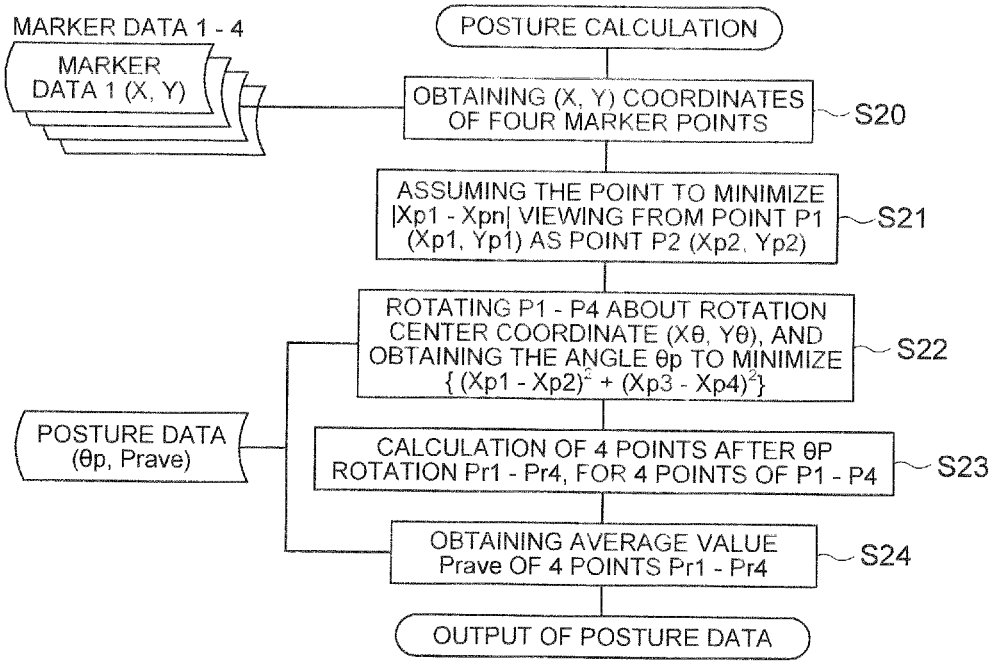
FIG. 9 is a flow chart describing maintenance operations in the inkjet drawing apparatus relating the first embodiment.

FIG. 9 shows a flow of posture calculation. Firstly obtaining each positional coordinate (X, Y) of four points of positioning marker 207, and memorizes them as marker data 1 to 4 (S20).

Next, by assuming the positional coordinates of point P2, that minimizes the value of $\sqrt[3]{Xp1-Xpn}$ (n=2, 3, or 4) viewed from positional coordinates (Xp1, Yp1) of any one of positioning markers 207 (assumed to be P1), to be (Xp2, Yp2), other positional coordinates P3 and P4 are assumed respectively to be (Xp3, Yp3) and (Xp4, Yp4) (S21).

By rotating the positional coordinates P1-P4 of the four positioning markers 207 about the rotation center coordinates (Xθ, Yθ) positioned at the center of drawing table 11, obtaining the angle θp that minimizes the value of $\{(Xp1-Xp2)^2+(Xp3-Xp4)^2\}$ and the angle θp is memorized (S22).

Next, with respect to the positional coordinates P1-P4 of the four points of positioning markers 207, calculating the positional coordinates of four points after the rotation by angle θp (S23), and the average value Prave of positional coordinates Pr1-Pr4 of the four points is obtained and memorized (S24).

Returning to FIG. 8, the posture data of wiping unit m1, having been obtained by the above process, is memorized as the present posture data (θm, Mrave) of wiping unit m1 on maintenance unit installation section 13 (S5).

Figure 13:
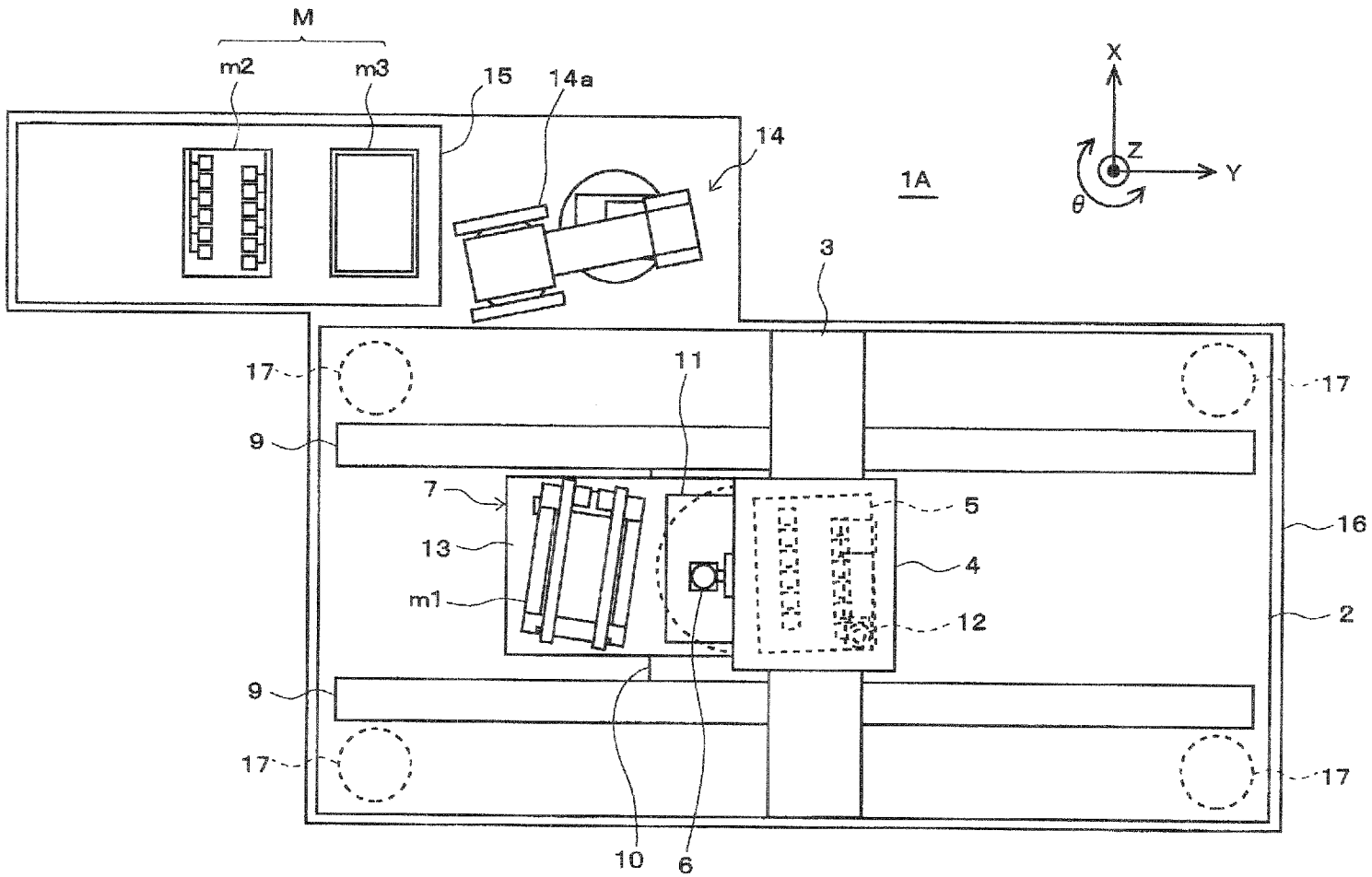
FIG. 13 is a plan view showing maintenance operations in the inkjet drawing apparatus relating the first embodiment.

On the other hand, by moving transfer stage 7 in X and Y directions, moving the second camera 12 attached on transfer stage 7 toward position under head module 5 (S6), any of positioning marker 52 formed on bottom surface of head module is confirmed through image confirmation by the second camera 12 (S7, FIG. 13). This confirmation operation is repeated for times of the number of position confirmation marker 52. The confirmed positional coordinates of each position confirmation markers 52 is assumed to be head marker data, and according to the flow of FIG. 9 similarly to the above description, posture data (θh, Hrave) is calculated and memorized (S8).

Either one series of above two series of processes S3-S5 and processes S6-S8 may be executed before the other series. Further as the first process of maintenance operation, the above series of steps S6-8 may be executed first to previously obtain posture data of head module 5.

After completing both the above series of steps of S3-S5 and S6-S8, the memorized posture data of wiping unit m1, and the posture data of head module 5 are read out, and from these data the posture of contact for head module 5 and wiping unit m1 (the posture where each head 51 of head module 5 and each wiping member 201 of wiping unit m1 contact properly with each other) is calculated (S9).

To be more specific, since wiping unit m1 has been transported and simply placed onto maintenance unit installation section 13, accurate positioning to each head 51 of head module 5 is not executed. Therefore in order to wipe each head 51 with wiping unit m1, the postures of both units are required to be adjusted to coincide. In order to adjust both postures, although head module 5 and wiping unit m1 may be relatively moved, only wiping unit m1 is moved in the X, Y, and θ directions to make the posture of wiping unit m1 coincide with the posture of head module 5.

Figure 10:
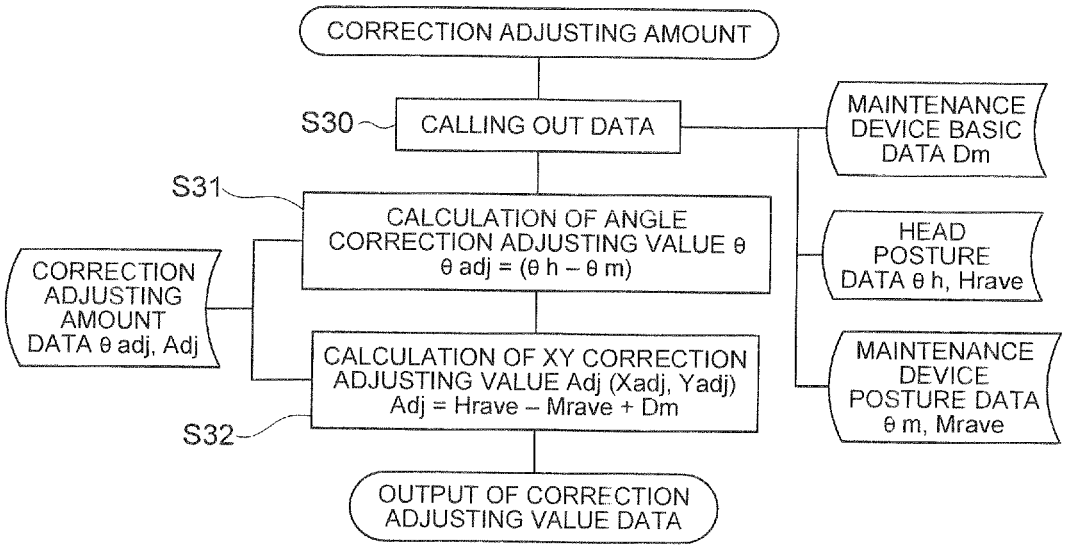
FIG. 10 is a flow chart describing maintenance operations in the inkjet drawing apparatus relating the first embodiment.
Figure 11:
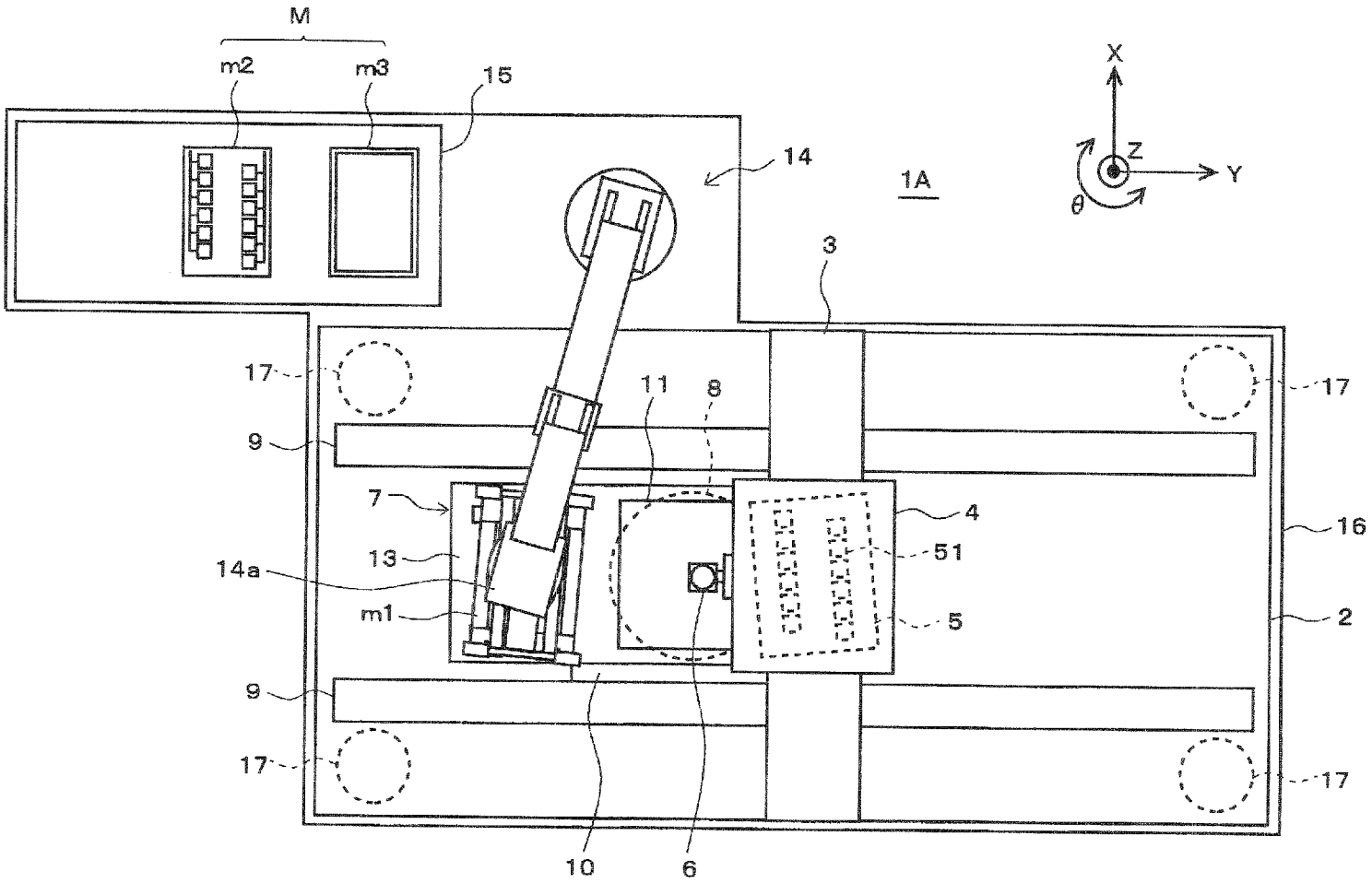
FIG. 11 is a plan view showing maintenance operations in the inkjet drawing apparatus relating the first embodiment.

FIG. 10 shows a flow for calculating the correction adjusting amount for moving wiping unit m1. Firstly called out are the memorized data of posture data (θm, Mrave) of wiping unit m1, posture data (θh, Hrave) of head module 5, and maintenance device basic data Dm (S30). Maintenance device basic data Dm includes information of contact position relationship between head module 5 and wiping unit m1.

Next, based on these data, angle correction adjusting value θadj (=θh−θm) for adjusting wiping unit m1 to the posture of head module 5 is calculated, and the result is memorized (S31).

Further, based on the above posture data and maintenance device basic data Dm, XY correction adjusting value Aadj (Xadj, Yadj) (=Hrave−Mrave+Dm) for adjusting wiping unit m1 to the posture of mead module 5 is calculated, and the result is memorized (S32).

Figure 14:
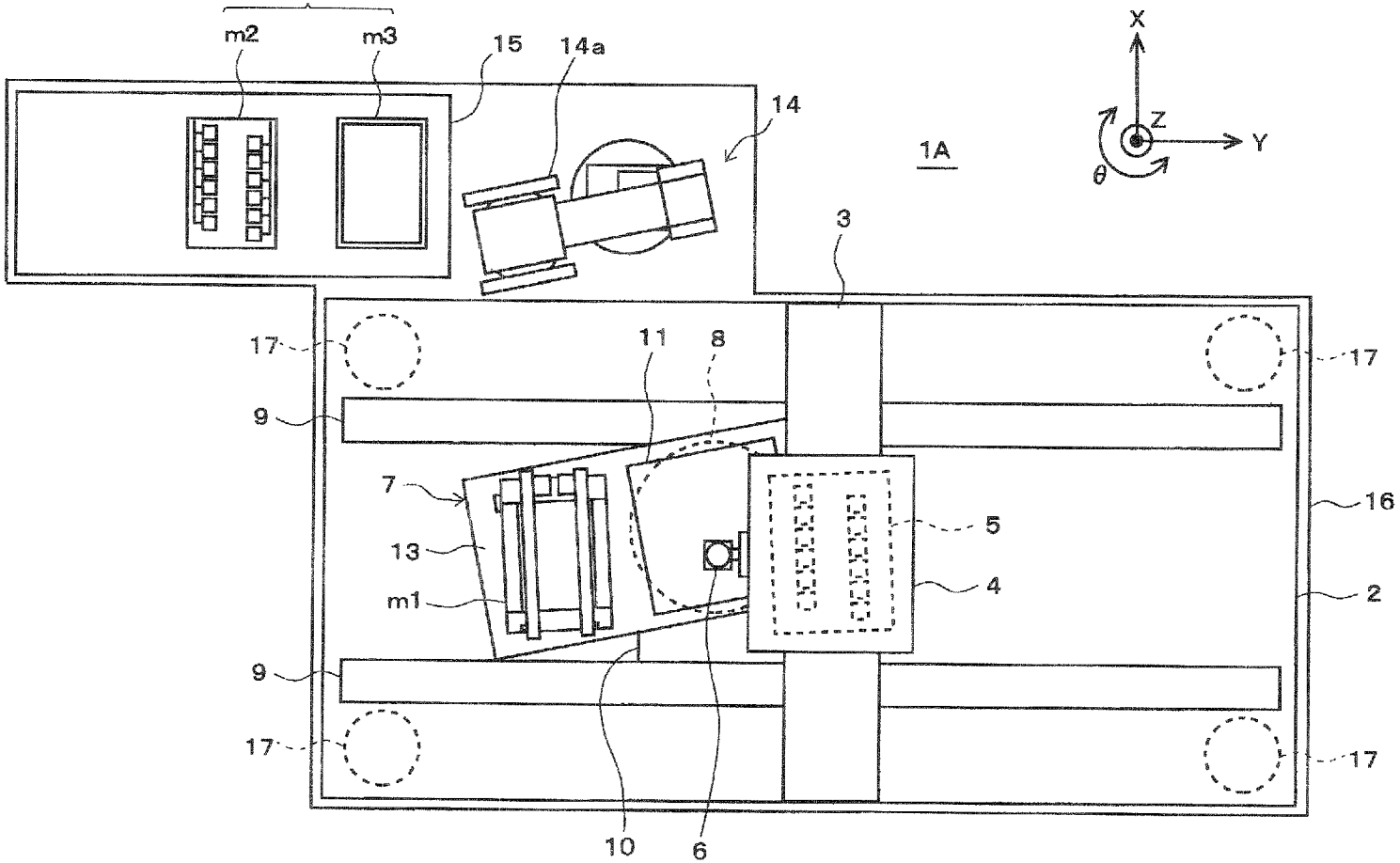
FIG. 14 is a plan view showing maintenance operations in the inkjet drawing apparatus relating the first embodiment.

Then, returning to FIG. 8, based on the correction adjusting amount data obtained by the above described S31 and S32, transfer stage 7 is moved in X, Y, and θ directions to finely adjust the position of wiping unit m1 (S10). By this means, the posture of wiping unit m1 on transfer stage 7 is made to coincide with the posture of head module 5 (FIG. 14).

Figure 15:
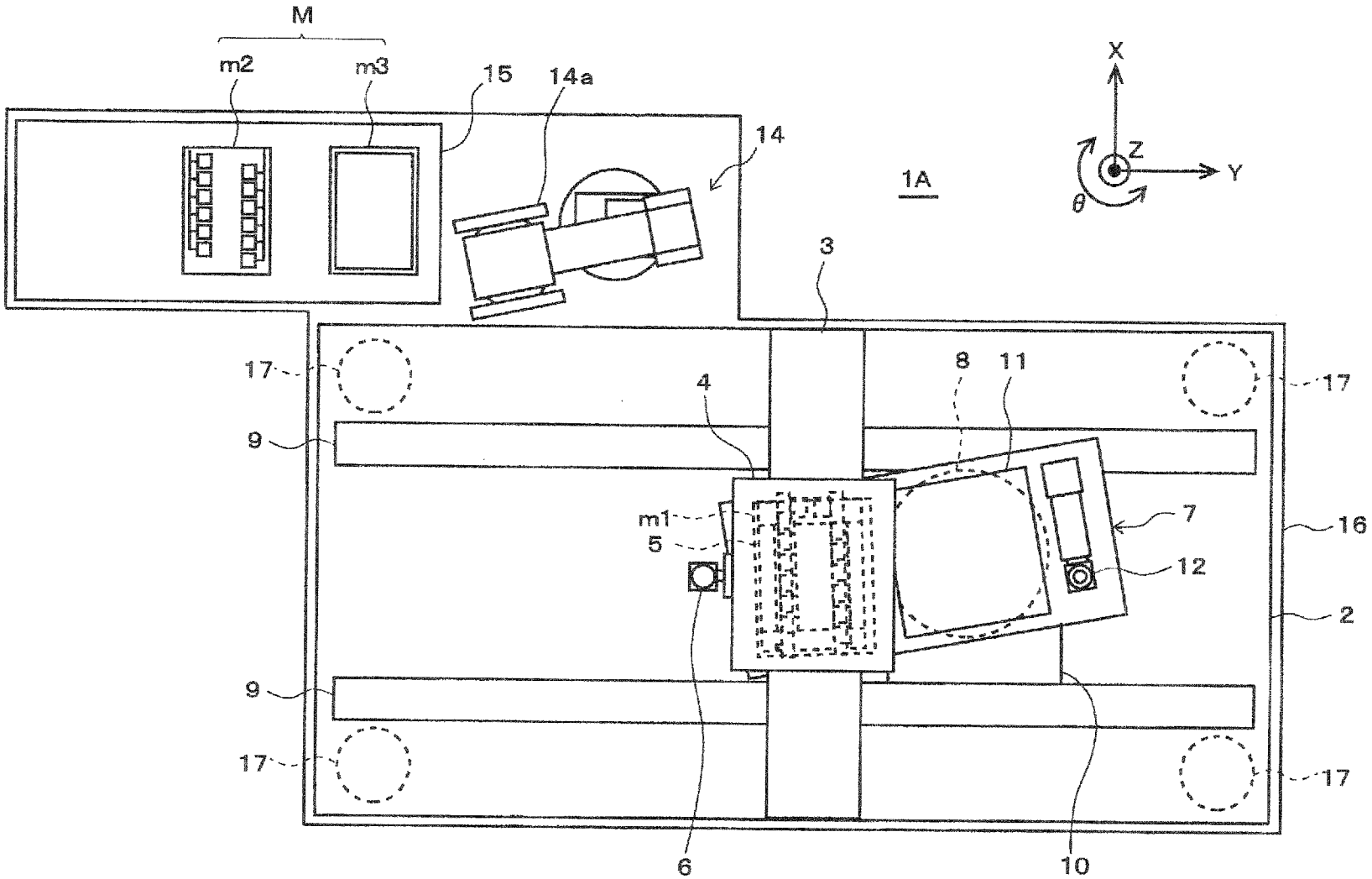
FIG. 15 is a plan view showing maintenance operations in the inkjet drawing apparatus relating the first embodiment.

After that, by moving transfer stage 7 such that wiping unit m1 comes to the position just under head module 5, moving down Z-stage 4 such that head module 5 contacts with wiping unit m1, and executes the head maintenance (S11, FIG. 15).

As described above, according to inkjet drawing apparatus 1A relating to the present invention, since only one kind of maintenance unit among the plural kinds of maintenance units M (m1, m2, m3) is required to be installed on transfer stage 7, transfer stage 7 need not be made long and large sized. Further, since the mechanism for installing maintenance unit M onto transfer stage (maintenance unit installation mechanism 14) is not provided on the same fixed platen 2 as transfer stage 7, a positional shift of head 51 due to the vibration caused by the installation operation of maintenance unit M is suppressed and highly accurate maintenance is made possible.

Second Embodiment

Figure 16:
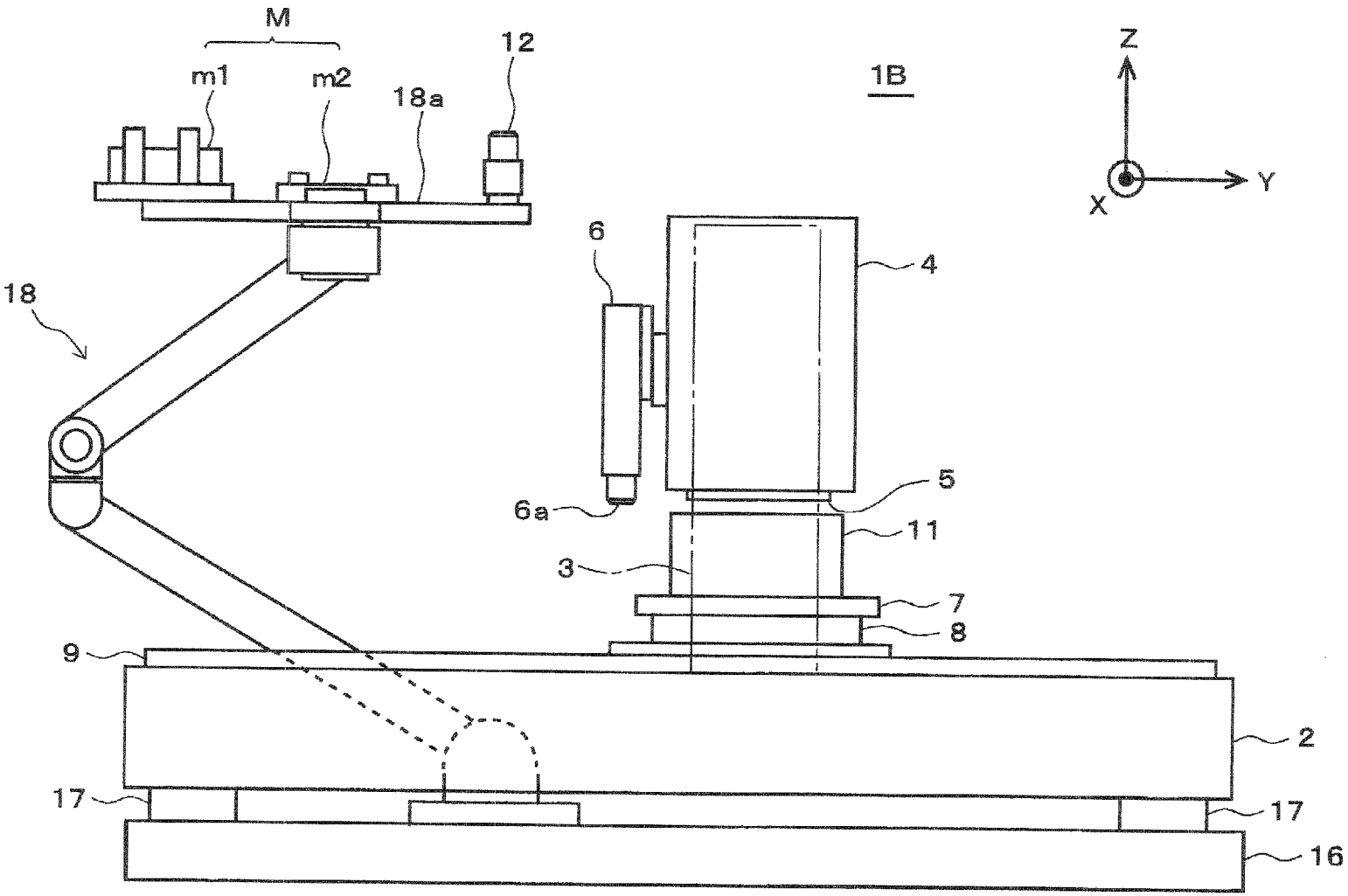
FIG. 16 is a side elevation view of an inkjet drawing apparatus relating to the second embodiment.
Figure 17:
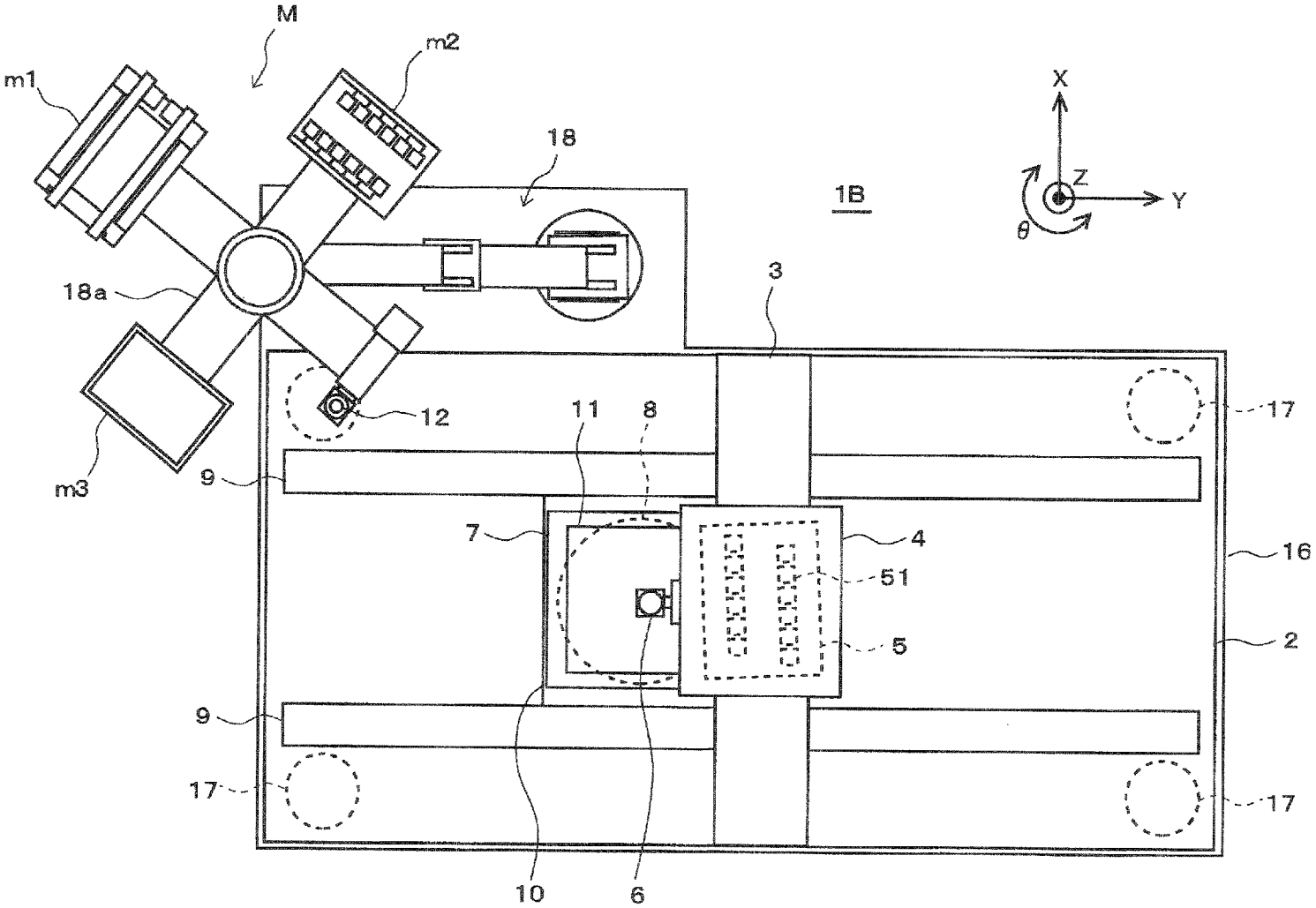
FIG. 17 is a plan view of an inkjet drawing apparatus relating to the second embodiment.

FIG. 16 is a side elevation view of an inkjet drawing apparatus relating to the second embodiment of the present invention, and FIG. 17 is its plan view. Since the part given the same designation as that of inkjet drawing apparatus 1A is the identical component part, its detailed explanation will be omitted.

In this inkjet drawing apparatus 1B on transfer stage 7, not provided are the maintenance unit installation section and the second camera, both of which are provided in the first embodiment. Plural kinds of maintenance unit M are provided on maintenance unit transfer mechanism 18 arranged at the side of fixed platen 2. Therefore, only drawing table 11 is provided on transfer stage 7.

This maintenance unit transfer mechanism 18 is configured with a multiple-jointed robot similarly to maintenance unit installation mechanism 14 of the first embodiment, and arranged at the side of fixed platen 2 without being provided on fixed platen 2. Therefore, any vibration caused by its movement does not affect head module 5 on fixed platen 2, and the installation space of maintenance unit transfer mechanism 18 is not required on fixed platen 2. Similarly to the first embodiment, maintenance unit installation mechanism 14 may be installed on apparatus base table 16 at the side of fixed platen 2.

At the forefront of maintenance unit installation mechanism 14, rotation table 18*a*, on which all of the plural kinds of maintenance unit M (m1, m2, and m3) are arranged, is provided. Rotation table 18*a* is rotatable in a horizontal θ direction at the forefront of the aim, and at predetermined prescribed positions on its upper surface, respectively arranged and fixed are the plural kinds of maintenance unit M (m1, m2, and m3) and second camera 12 for image confirming the position of head module 5 upward from the bottom surface side.

By driving each joints of maintenance unit transfer mechanism 18, rotation table 18*a* is movable in the horizontal and vertical directions within a prescribed region including the portion just under head module 5. Further, by rotating the rotation table 18*a*, one kind of unit among the plural kinds of maintenance unit M (m1, m2, and m3) can be executed positioning to just under head module 5, and after the positioning, the unit can be made contact with each head 51 by raising the arm. Therefore, in the present embodiment this maintenance unit transfer mechanism 18 configures the maintenance unit transfer means of the present invention.

Positional information accompanied by each moving operation of maintenance unit transfer mechanism 18 is respectively detected accurately by an encoder (not illustrated).

Similarly to the first embodiment, in inkjet drawing apparatus 1B of the second embodiment, by selecting arbitrary one kind of maintenance unit M among the plural kinds of maintenance unit M (m1, m2, and m3) and rotating rotation table 18*a*, the selected maintenance unit M is positioned to coincide with the posture of head module 5 at the bottom of head module 5.

Figure 8:
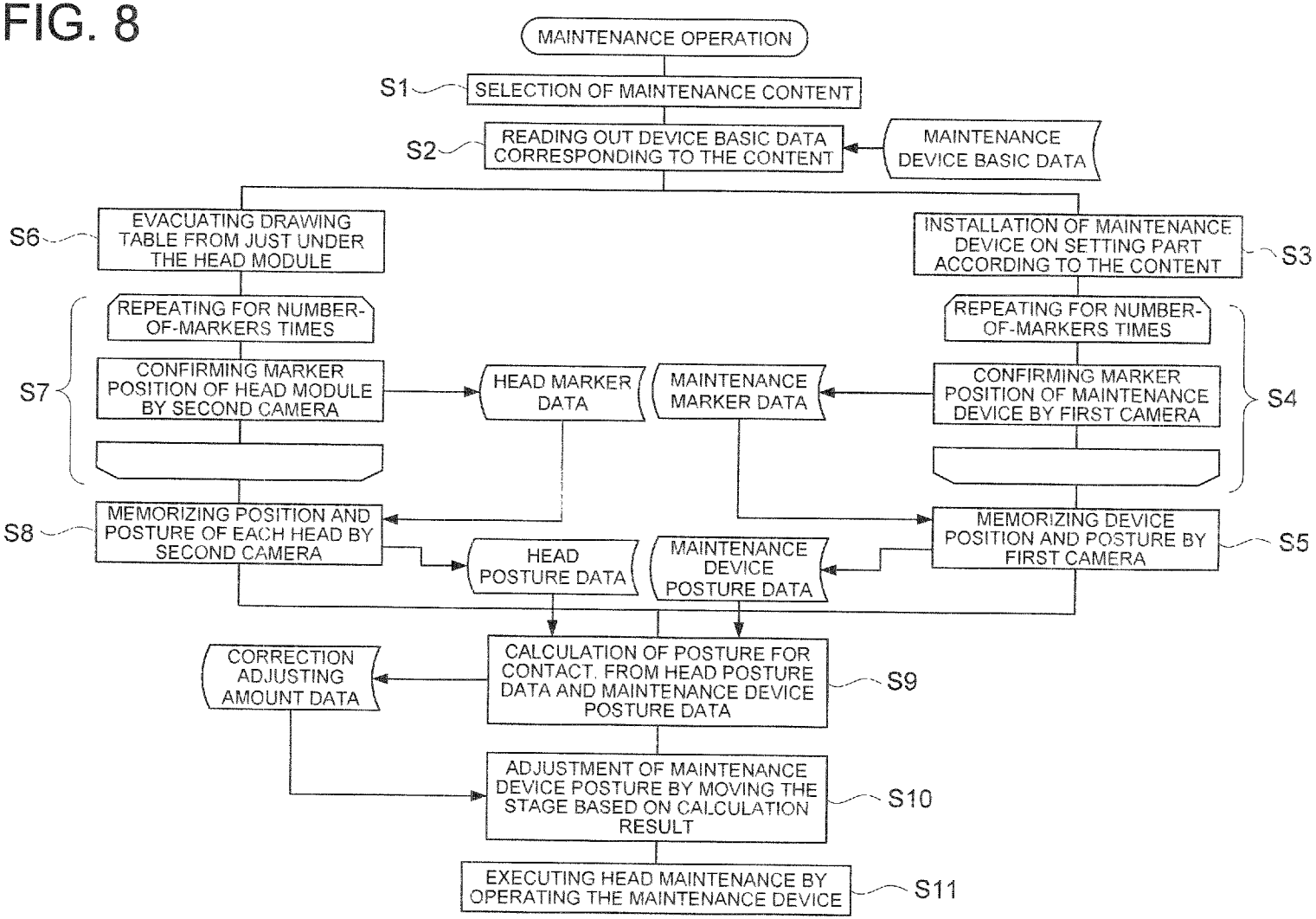
FIG. 8 is a flow chart describing maintenance operations in the inkjet drawing apparatus relating the first embodiment.
Figure 18:
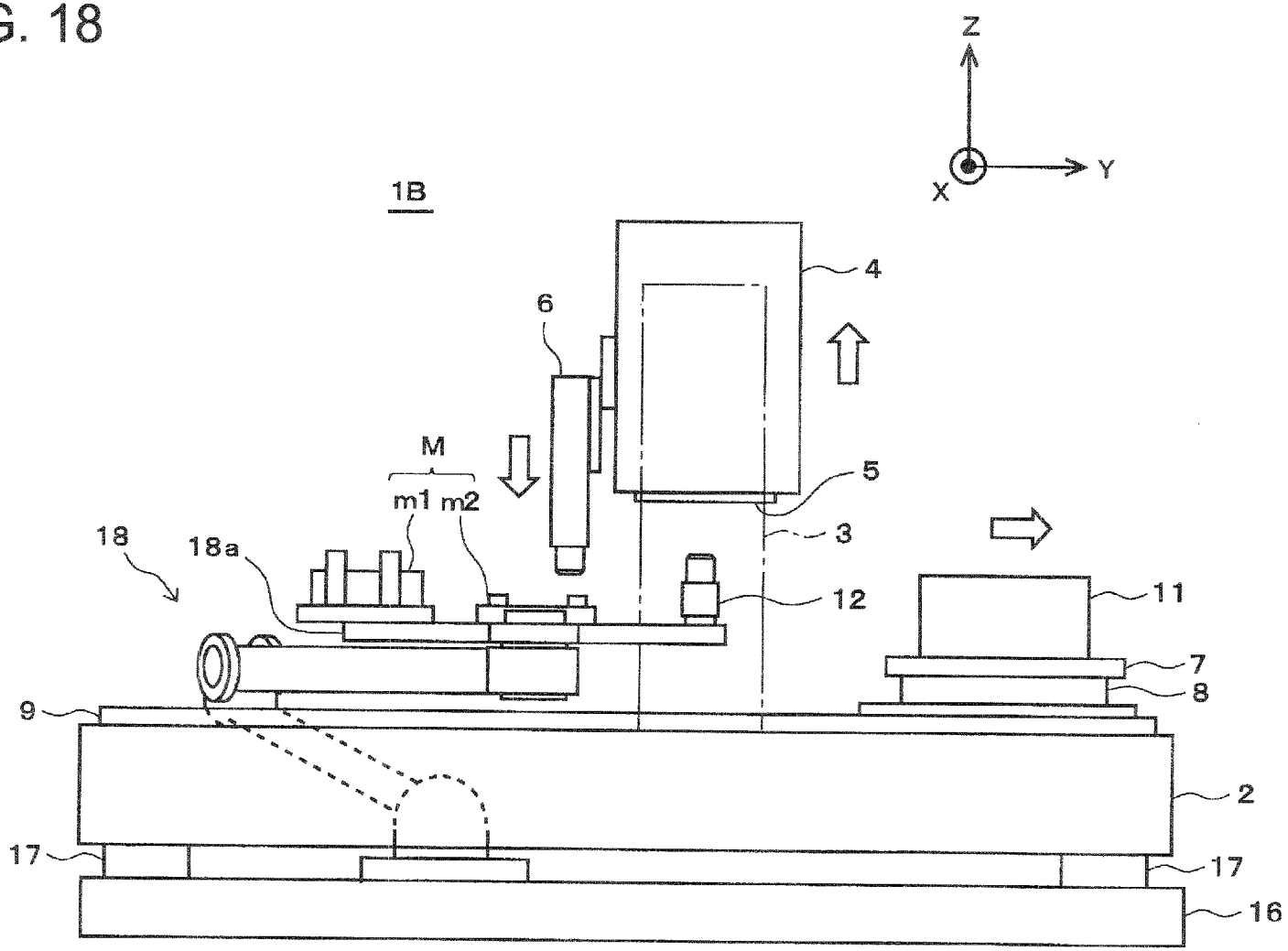
FIG. 18 is a plan view showing maintenance operations in the inkjet drawing apparatus relating the second embodiment.

Also in the present embodiment, this positioning operation can be executed according to FIG. 8-FIG. 10, however, since second camera 12 is installed on rotation table 18*a* in the present embodiment, by inserting second camera 12 to the under part of head module 5 from when drawing table 11 has evacuated, the position of head module 5 is confirmed (FIG. 18). At this time, Z-stage 4 moves upward to form an enough insertion space under it.

Figure 19:
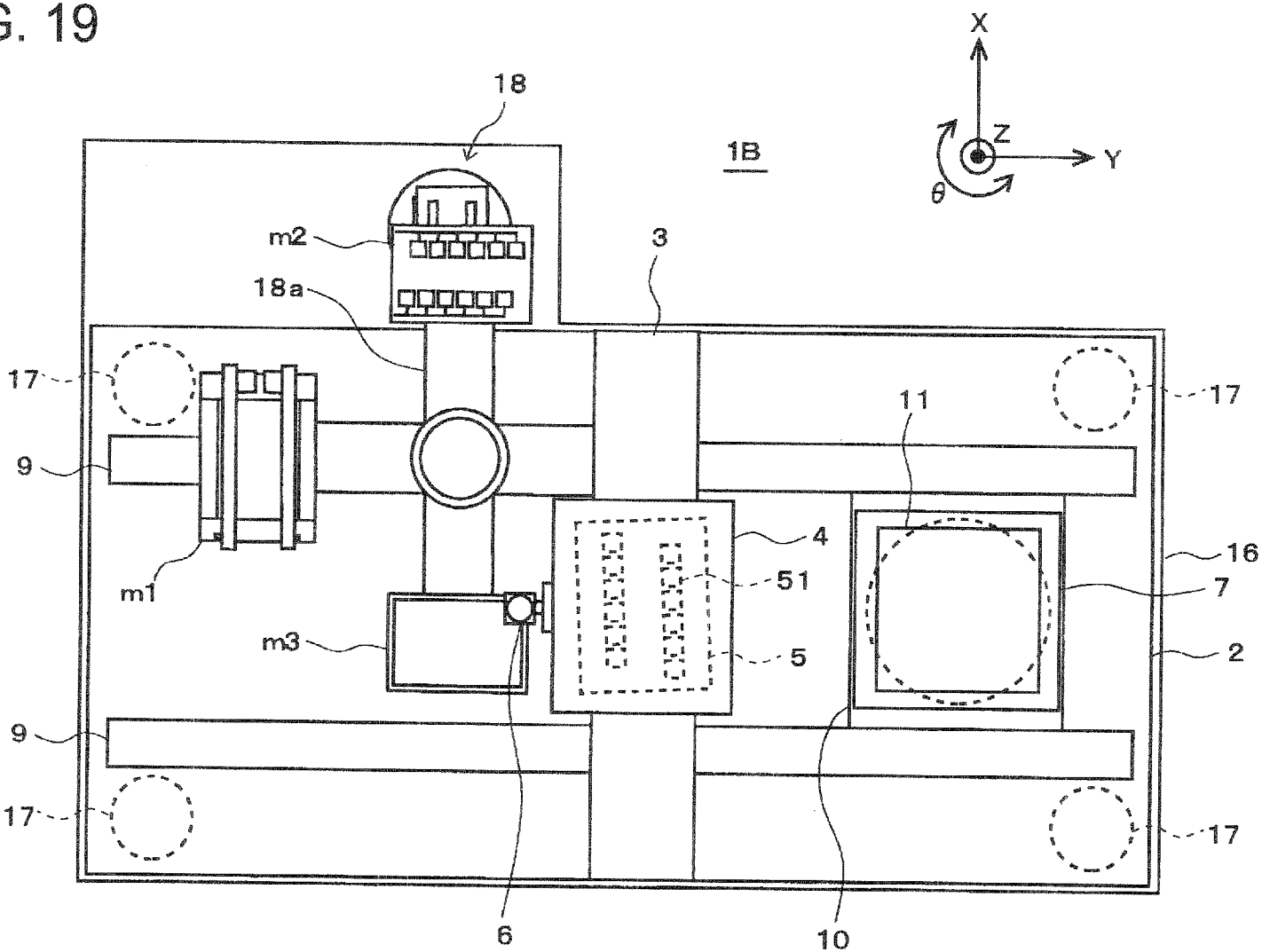
FIG. 19 is a plan view showing maintenance operations in the inkjet drawing apparatus relating the second embodiment.
Figure 20:
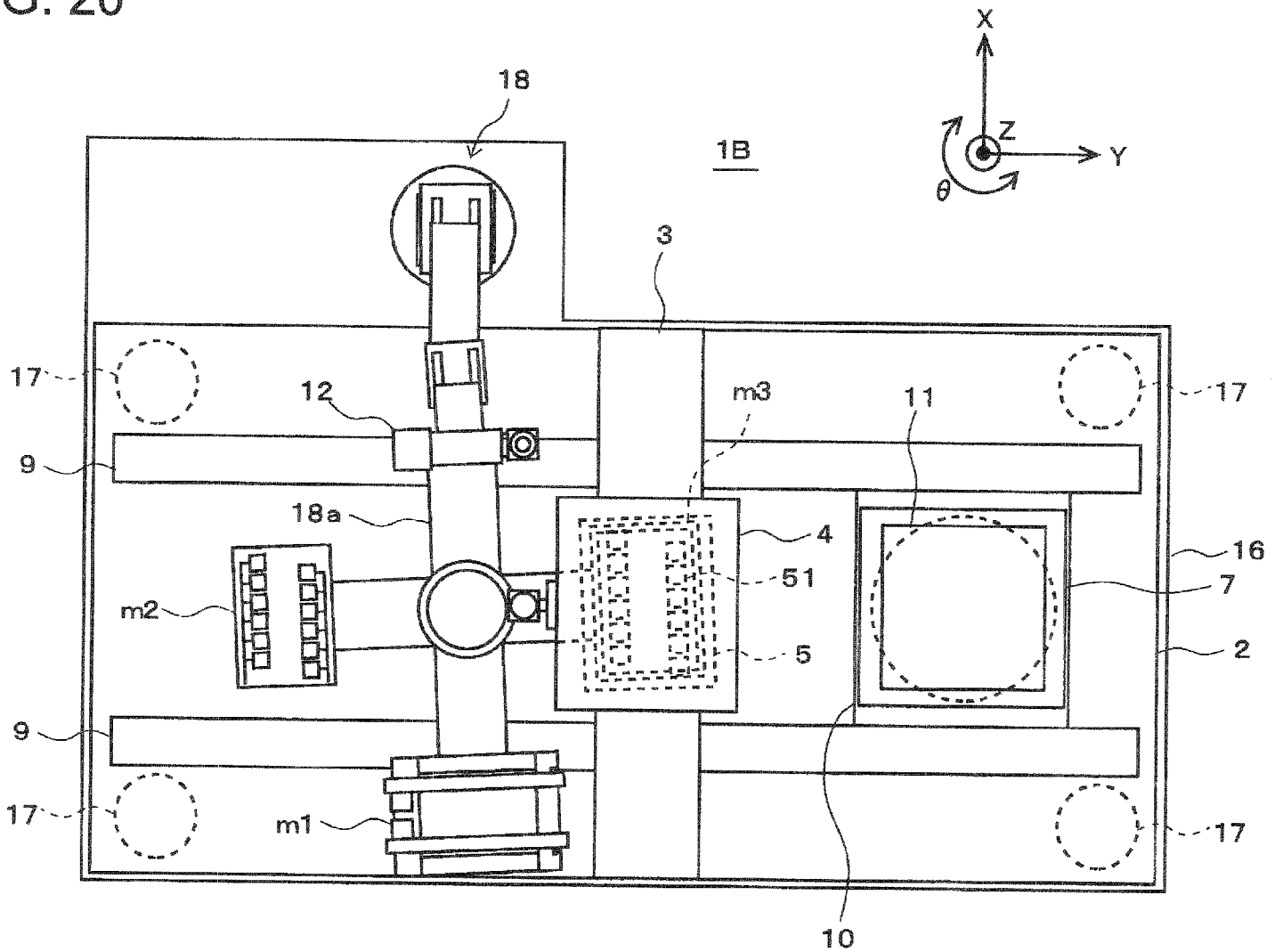
FIG. 20 is a plan view showing maintenance operations in the inkjet drawing apparatus relating the second embodiment.

After that, in cases when flushing tray m3 is selected for example, rotation table 18*a* rotates and transports flushing tray m3 toward the portion under first camera 6, and positional confirmation is executed by said first camera 6 (FIG. 19). At this time, first camera 6 comes down for image confirming of positioning marker 402 on flushing tray m3. After that, rotation table 18*a* is rotated such that flushing tray m3 coincides with the posture of head module 5 to make flushing tray m3 positioned under the head module 5 (FIG. 20).

In the present embodiment, transfer stage 7 provided with drawing table 11 is made movable by Y-movement mechanism 9 in Y-direction on fixed platen 2 up to a position (maintenance position) when said drawing table 11 is sufficiently evacuated from the position under head module 5. Thus the space, where rotation table provided with maintenance unit M (m1, m2, and m3) and second camera 12 can be inserted, is ensured under head module 5. Since drawing table 11 is formed high to protrude from the surface of transfer stage 7, the moving distance for lifting up head module 5 to insert rotation table 18*a* into the position under head module 5 can be made short.

According to inkjet drawing apparatus relating to the second embodiment, similar effects to the first embodiment can be also attained, in addition, the arrangement table for arranging plural kinds of maintenance unit M (m1, m2, and m3) is not required to be separately provided, which enables to make the total apparatus installation space compact.

Another Embodiments of Maintenance Unit Selecting/Arranging Means

Maintenance unit installation mechanism 14, which is an example of maintenance unit selecting/arranging means explained in the first embodiment, may be configured as below alternatively to the configuration of multiple-jointed robot arm.

Figure 21:
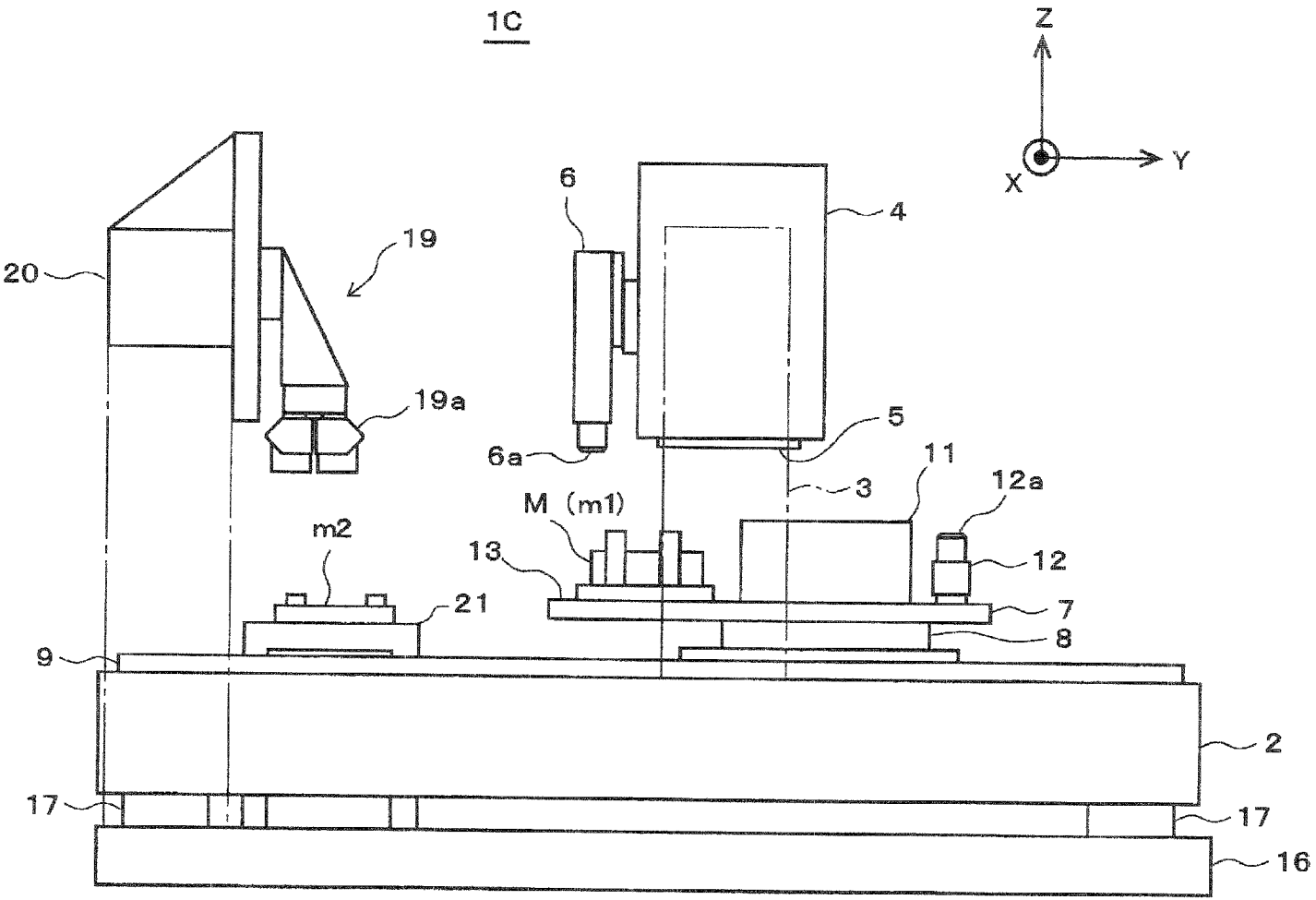
FIG. 21 is a side elevation view of an inkjet drawing apparatus provided with another embodiment of maintenance unit selecting/arranging means.
Figure 22:
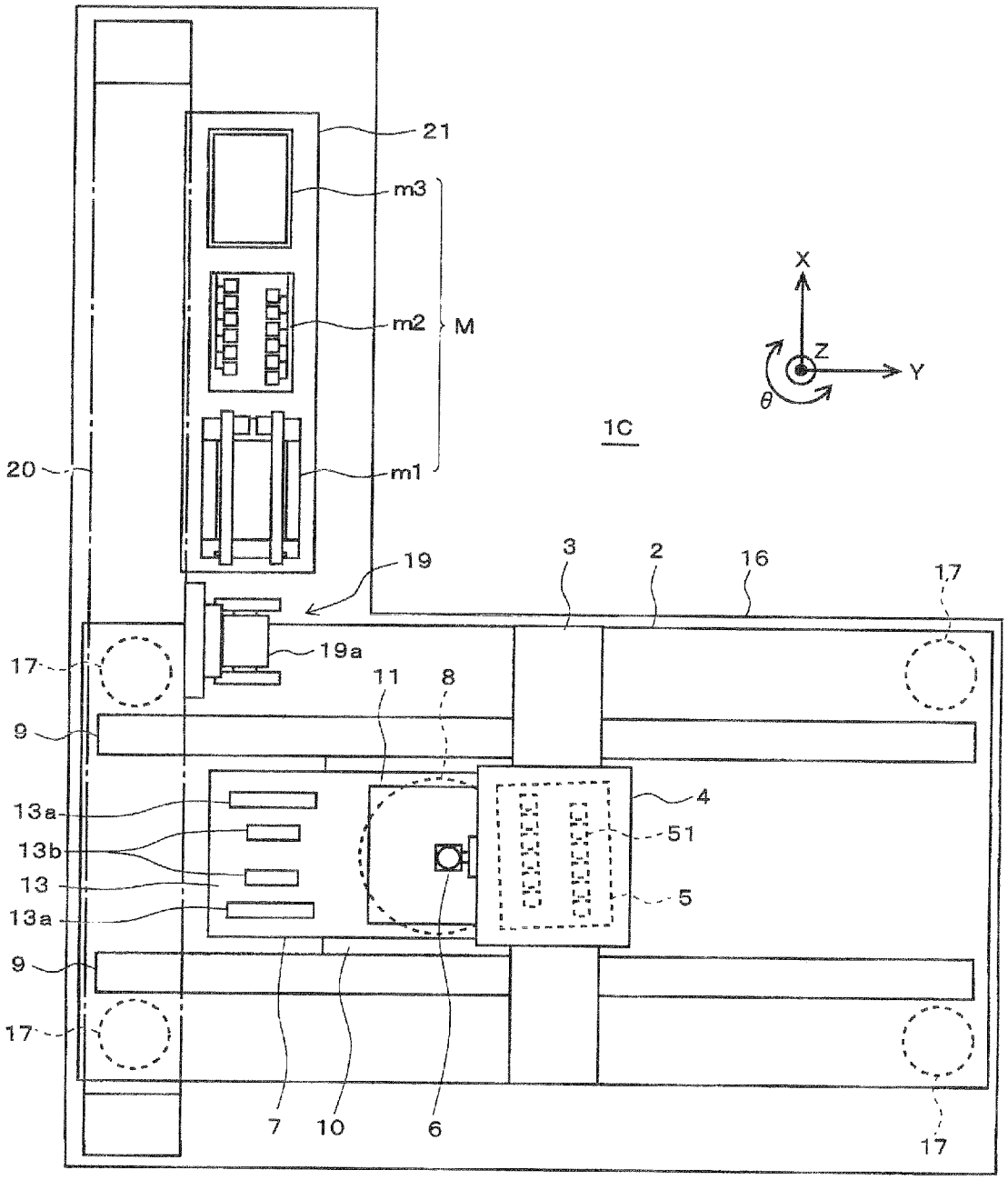
FIG. 22 is a plan view of an inkjet drawing apparatus provided with the other embodiment of maintenance unit selecting/arranging means.

FIG. 21 is a side elevation view of an inkjet drawing apparatus provided with the other embodiment of maintenance unit selection/placing means, and FIG. 22 is its plan view. Since the part given a same designation as that of FIG. 1 or FIG. 2 is the identical component part, its detailed explanation will be omitted.

In this inkjet drawing apparatus 1C, at an end side of fixed platen 2 along Y-direction in the drawing, gantry 20 is provided along X-direction in the drawing so as to step over transfer stage 7 and fixed platen 2. Therefore, in this case gantry 20 is not installed on fixed platen 2, but installed on apparatus base table 16. On gantry 20, maintenance unit installation mechanism 19 for installing maintenance unit M onto maintenance unit installation section 13 on transfer stage 7 is provided to be capable of slide movement in X-direction in the drawing and also vertical movement in Z-direction.

At the side of fixed platen 2, maintenance unit arrangement table 21 is provided on apparatus base table 16, and on its upper surface, the plural kinds of maintenance unit M (m1, m2, and m3) are arranged, so as to be selectively usable, along X-direction similarly to gantry 20.

This maintenance unit installation mechanism 19 has, on its bottom end, hand unit 19*a* to grab and hold the maintenance unit M, and is configured to selectively grab and hold any one of maintenance unit among the plural kinds of maintenance unit M (m1, m2, and m3) by hand unit 19*a*, and to allow slide movement along gantry 20 to install on maintenance unit installation section 13 on transfer stage 7 which has moved to the position (installation waiting position) under gantry 20. Thus, the maintenance unit selecting arranging means of the present invention is configured with this maintenance unit installation mechanism 19 provided on gantry 20.

By this inkjet drawing apparatus 1C, similar effects can be also attained to the first embodiment.

EXPLANATION OF DESIGNATIONS

1A, 1B, 1C: inkjet drawing apparatus
2: fixed platen
3: gantry
4: Z-stage
5: head module
51: head
51*a*: nozzle
52: position confirmation marker
6: first camera
6*a* lens surface
7: transfer stage
8: θ-rotation mechanism
9: Y-movement mechanism
10: X-movement mechanism
11: drawing table
12: second camera
12*a*: lens surface
13: maintenance unit installation section
13*a*: holding mechanism
13*b*: electrode
14, 19: maintenance unit installation mechanism
14*a*, 19*a*: hand unit
15, 21: maintenance unit arrangement table
16: apparatus base table
17: vibration-free mechanism
18: maintenance unit transfer mechanism
18*a*: rotation table
20: gantry
M: maintenance unit
m1: wiping unit
m2: sucking unit
m3: flushing tray

What is claimed is:

1. An inkjet drawing apparatus comprising:

a head module which holds a droplet jetting head provided with a nozzle for ejecting droplets, and which is configured to be unmovable in a horizontal direction;

a drawing table adapted to support a recording member on an upper surface, and which is configured to be movable in the horizontal direction, wherein the inkjet drawing apparatus executes a prescribed drawing by ejecting the droplets onto the recording member from the droplet jetting head;

a maintenance unit transfer mechanism which is configured to be movable within a prescribed region including a position just under the head module, and which transfers a maintenance unit for conducting a maintenance of the droplet jetting head toward the position just under the head module, and executes positioning of the maintenance unit with respect to the droplet jetting head; and a maintenance unit selecting/arranging mechanism which selects one of a plurality of kinds of maintenance units for conducting the maintenance of the droplet jetting head, and places the selected maintenance unit on the maintenance unit transfer mechanism;

wherein the maintenance unit selecting/arranging mechanism comprises a holding unit to hold the selected maintenance unit and a moving unit to move the maintenance unit held by the holding unit to the maintenance unit transfer mechanism; and wherein the maintenance unit selecting/arranging mechanism is installed on a surface of a different member from a platen on which the head module is installed, and the surface of the different member is arranged at a lower position than a surface of the platen on which the head module is installed.

2. The inkjet drawing apparatus described in claim 1, further comprising a relative position measuring mechanism which measures a relative position between the head module and the maintenance unit being transferred by the maintenance unit transfer mechanism, wherein the maintenance unit transfer mechanism executes a fine adjustment of a position of the maintenance unit based on a value measured by the relative position measuring mechanism.

3. The inkjet drawing apparatus described in claim 1, wherein the maintenance unit selecting/arranging mechanism is configured with a robot arm capable of holding the selected maintenance unit at an end of the robot arm.

4. The inkjet drawing apparatus described in claim 1, wherein the maintenance unit selecting/arranging mechanism is configured to be capable of slide movement along a gantry which is provided to step over the maintenance unit transfer mechanism, and also capable of up-and-down movement, and wherein the holding unit of the maintenance unit selecting/arranging mechanism is a hand unit which can hold the selected maintenance unit at a lower end of the hand unit.

5. The inkjet drawing apparatus described in claim 1, further comprising a maintenance unit arranging table, on an upper surface of which the plurality of kinds of maintenance units are arranged.

6. The inkjet drawing apparatus described in claim 1, wherein the head module and the drawing table are arranged on a common fixed platen, and the maintenance unit selecting/arranging mechanism is not arranged on the common fixed platen.

7. The inkjet drawing apparatus described in claim 1, wherein the drawing table and the maintenance unit transfer mechanism are provided on a common stage which is movable in the horizontal direction within the prescribed region including the position just under the head module, and which is rotatable about an axis perpendicular to the upper surface of the drawing table.

8. The inkjet drawing apparatus described in claim 1, wherein the drawing table is configured to move to a position where the drawing table does not interfere with the maintenance unit at the time of maintenance by the maintenance unit, and wherein the drawing table is configured so that a space to insert the maintenance unit under the head module is ensured.

* * * * *